US009911384B2

(12) United States Patent
Park

(10) Patent No.: US 9,911,384 B2
(45) Date of Patent: Mar. 6, 2018

(54) SCAN DRIVER, ORGANIC LIGHT EMITTING DIODE DISPLAY DEVICE AND DISPLAY SYSTEM INCLUDING THE SAME

(71) Applicant: SAMSUNG DISPLAY CO., LTD., Yongin-si, Gyeonggi-do (KR)

(72) Inventor: Su-Hyeong Park, Gyeongju-si (KR)

(73) Assignee: Samsung Dispaly Co., Ltd., Yongin-si (KR)

( * ) Notice: Subject to any disclaimer, the term of this patent is extended or adjusted under 35 U.S.C. 154(b) by 148 days.

(21) Appl. No.: 14/963,101

(22) Filed: Dec. 8, 2015

(65) Prior Publication Data

US 2016/0365035 A1 Dec. 15, 2016

(30) Foreign Application Priority Data

Jun. 15, 2015 (KR) ..... 10-2015-0084128

(51) Int. Cl.
*G09G 5/10* (2006.01)
*G09G 3/3266* (2016.01)

(52) U.S. Cl.
CPC ... *G09G 3/3266* (2013.01); *G09G 2300/0819* (2013.01); *G09G 2300/0842* (2013.01); *G09G 2300/0861* (2013.01); *G09G 2310/0262* (2013.01); *G09G 2310/0286* (2013.01); *G09G 2310/08* (2013.01); *G09G 2330/021* (2013.01)

(58) Field of Classification Search
CPC ..... G09G 3/3266; G09G 2300/0819; G09G 2300/0842; G09G 2300/0861; G09G 2310/0262; G09G 2310/0286; G09G 2310/08; G09G 2330/021
See application file for complete search history.

(56) References Cited

U.S. PATENT DOCUMENTS 8,686,990 B2 * 4/2014 Yamamoto ..... G11C 19/184 345/214
8,816,728 B2 8/2014 Yoon et al.
(Continued)

FOREIGN PATENT DOCUMENTS

KR 2001-0112310 A 12/2001
KR 2003-0080148 A 10/2003
(Continued)

*Primary Examiner* — Peter D McLoone
(74) *Attorney, Agent, or Firm* — Lewis Roca Rothgerber Christie LLP

(57) ABSTRACT

A scan driver of an organic light emitting diode (OLED) display device includes a plurality of sequentially-connected stages each connected to a plurality of pixels through a plurality of first-scan lines and a plurality of second-scan lines. Each stage of the sequentially-connected stages includes a common driver and a sub-driver unit. The common driver is configured to concurrently provide a common first-scan signal to the first-scan lines of the stage in response to at least a first initialization signal and a second initialization signal. The sub-driver unit is configured to serially provide second-scan signals to the second-scan lines of the stage in response to a plurality of output enable signals, the first-scan signal, and one of the first initialization signal and the second initialization signal. An order of the serial providing of the second-scan signals to the second-scan lines is dynamically configurable based on the output enable signals.

20 Claims, 15 Drawing Sheets

(56) References Cited

U.S. PATENT DOCUMENTS

| | | | | |
|---|---|---|---|---|
| 9,007,281 | B2 * | 4/2015 | Yoon | G09G 3/3233 345/76 |
| 9,286,834 | B2 * | 3/2016 | Yoon | G09G 3/3291 |
| 2011/0279433 | A1 * | 11/2011 | Ryu | G09G 3/3233 345/211 |
| 2011/0285757 | A1 * | 11/2011 | Cummings | G09G 3/2003 345/690 |
| 2013/0113779 | A1 * | 5/2013 | Yoon | G09G 3/3233 345/212 |
| 2013/0120228 | A1 * | 5/2013 | Yoon | G09G 3/3291 345/80 |
| 2013/0235026 | A1 * | 9/2013 | Yamamoto | G11C 19/184 345/214 |
| 2015/0070343 | A1 * | 3/2015 | Lee | G09G 3/20 345/212 |
| 2015/0154897 | A1 * | 6/2015 | Elsayed | G09G 3/18 345/38 |
| 2015/0194110 | A1 | 7/2015 | Park et al. | |
| 2016/0314737 | A1 * | 10/2016 | Park | G09G 3/3677 |
| 2016/0379571 | A1 * | 12/2016 | Kim | G09G 3/3233 345/215 |
| 2017/0154572 | A1 * | 6/2017 | Kim | G09G 3/3233 |
| 2017/0206824 | A1 * | 7/2017 | Sun | G09G 3/2092 |
| 2017/0243542 | A1 * | 8/2017 | Xiang | G09G 3/3258 |

FOREIGN PATENT DOCUMENTS

| | | | |
|---|---|---|---|
| KR | 10-2013-0131938 | A | 12/2013 |
| KR | 10-2015-0057321 | A | 5/2015 |
| KR | 10-2015-0082774 | A | 7/2015 |
| KR | 10-2016-0127211 | | 11/2016 |

* cited by examiner

SCAN DRIVER, ORGANIC LIGHT EMITTING DIODE DISPLAY DEVICE AND DISPLAY SYSTEM INCLUDING THE SAME

CROSS-REFERENCE TO RELATED APPLICATION(S)

This application claims priority under 35 USC § 119 to Korean Patent Application No. 10-2015-0084128, filed on Jun. 15, 2015 in the Korean Intellectual Property Office (KIPO), the entire content of which is incorporated herein by reference.

BACKGROUND

1. Field

Aspects of embodiments of the present invention relate to display devices. More particularly, aspects of embodiments of the invention relate to scan drivers, organic light emitting diode (OLED) display devices including the scan drivers, and display systems including the OLED display devices.

2. Description of the Related Art

Various flat panel display devices having reduced weight and volume compared to cathode ray tube devices have been developed. Flat panel display devices include liquid crystal display (LCD) devices, field emission display (FED) devices, plasma display panels (PDPs), OLED display devices, etc. OLED display devices exhibit rapid response speed and low power consumption among the flat panel display devices because the OLED display devices display images using OLEDs that emit light based on recombinations of electrons and holes.

OLED display devices may include display panels having a plurality of pixels arranged in a matrix format and driving circuits transmitting image data signals and scan signals to the pixels to display images. In addition, the driving circuits may include a data driver transmitting the image data signals through data lines connected to the pixels and a scan driver transmitting scan signals through scan lines connected to the pixels for activating each of the pixels to display an image according to a respective one of the image data signals.

In general, the scan driver has a complicated circuit structure to sequentially transmit correct scan signals to the pixels included in the display panel for each pixel line such that an area occupied and power consumed by the scan driver is large in comparison to the other driving circuits. In addition, data voltage transitions (which may occur when data signals of significantly different voltages, such as data voltages corresponding to the brightest and dimmest luminance, are driven in consecutive horizontal periods on the same data line) can further lead to increased power consumption.

SUMMARY

Example embodiments of the present invention are directed to display devices. Further embodiments of the present invention are directed to scan drivers, OLED display devices including the scan drivers, and display systems including the OLED display devices.

Example embodiments of the present invention provide for a scan driver of an OLED display device capable of reducing power consumption. Further embodiments provide for an OLED display device including the scan driver capable of reducing power consumption. Still further embodiments provide for a display system including the OLED display device capable of reducing power consumption.

In an embodiment of the present invention, a scan driver of an organic light emitting diode (OLED) display device is provided. The scan driver includes a plurality of sequentially-connected stages each connected to a plurality of pixels through a plurality of first-scan lines and a plurality of second-scan lines. Each stage of the plurality of sequentially-connected stages includes: a common driver configured to concurrently provide a common first-scan signal to the first-scan lines of the stage in response to at least a first initialization signal and a second initialization signal; and a sub-driver unit configured to serially provide second-scan signals to the second-scan lines of the stage in response to a plurality of output enable signals, the first-scan signal, and one of the first initialization signal and the second initialization signal. An order of the serial providing of the second-scan signals to the second-scan lines is dynamically configurable based on the output enable signals.

The sub-driver unit may be further configured to serially provide the second-scan signals to the second-scan lines of the stage after the concurrent providing of the common first-scan signal to the first-scan lines of the stage.

The sub-driver unit may include a plurality of sub-drivers corresponding to the plurality of second-scan lines of the stage.

Each sub-driver of the plurality of sub-drivers may be configured to provide a corresponding one of the second-scan signals to a corresponding one of the second-scan lines of the stage in response to the common first-scan signal, one of the output enable signals, and the one of the first initialization signal and the second initialization signal of the stage.

The corresponding one of the second-scan signals may be synchronized with the one of the output enable signals supplied to the sub-driver.

In another embodiment of the present invention, an organic light emitting diode (OLED) display device is provided. The OLED display device includes: a display panel including a plurality of pixels; a driving circuit connected to the pixels through a plurality of scan blocks and a plurality of data lines, each of the scan blocks including a plurality of first-scan lines and a plurality of second-scan lines, the driving circuit being configured to provide first-scan signals to the first-scan lines of each of the scan blocks, to serially provide second-scan signals to the second-scan lines of each of the scan blocks, to provide data voltages to the data lines, and to adjust the serial providing of the second-scan signals to the second-scan lines of each of the scan blocks to lessen a number of transitions of the data voltages of the data lines compared to a sequential providing of the second-scan signals to the second-scan lines in each of the scan blocks; and a power supply to supply a low power supply voltage, a high power supply voltage, and an initialization voltage to the display panel.

The driving circuit may include: a scan driver configured to provide the first-scan signals and the second-scan signals to the pixels for each of the scan blocks; a data driver configured to provide the data voltages corresponding to data signals to the data lines connected to the pixels; an emission driver configured to provide emission control signals to a plurality emission control lines connected to the pixels; and a timing controller configured to control the scan driver, the data driver, the emission driver, and the power supply. The timing controller may be configured to process input image data to generate the data signals.

The timing controller may include: a block memory to store the input image data for the pixels connected to one or more of the scan blocks; a data analyzer to analyze the data voltage transitions of the input image data stored in the block memory to generate a scan sequence signal and a scan sequence control signal to lessen the number of data voltage transitions of the data lines compared to the sequential providing of the second-scan signals to the second-scan lines of the one or more of the scan blocks; a data arrangement unit to arrange the input image data according to the scan sequence signal to generate the data signals; and a signal generator to generate at least a first driving control signal to control the data driver and a second driving control signal to control the scan driver according to an input control signal and the scan sequence control signal.

The scan driver may include a plurality of sequentially-connected stages corresponding to the plurality of scan blocks, each stage of the plurality of sequentially-connected stages corresponding to a scan block of the plurality of scan blocks and including: a common driver configured to concurrently provide a common one of the first-scan signals to the first-scan lines of the scan block in response to at least a first initialization signal and a second initialization signal; and a sub-driver unit configured to serially provide ones of the second-scan signals to the second-scan lines of the scan block in response to a plurality of output enable signals, the one of the first-scan signals, and one of the first initialization signal and the second initialization signal. An order of the serial providing of the ones of the second-scan signals to the second-scan lines may be dynamically configurable based on the output enable signals.

The common driver may include: a first p-channel metal-oxide semiconductor (PMOS) transistor including a source coupled to a data terminal, a gate coupled to a first node coupled to a first clock terminal, and a drain coupled to a second node; a second PMOS transistor including a gate coupled to a second clock terminal and a drain coupled to the second node; a third PMOS transistor including a drain coupled to a source of the second PMOS transistor, a source coupled to a third node to receive a first voltage, and a gate coupled to a fourth node; a first capacitor coupled between the third node and the fourth node; a fourth PMOS transistor including a gate coupled to the second node, a drain coupled to the first node, and a source coupled to the fourth node; a fifth PMOS transistor including a source coupled to the fourth node, a gate coupled to the first node, and a drain to receive a second voltage; a sixth PMOS transistor including a source coupled to the third node, a gate coupled to the fourth node, and a drain coupled to a fifth node corresponding to an output terminal; a second capacitor coupled between the second node and the fifth node; and a seventh PMOS transistor including a source coupled to the fifth node, a gate coupled to the second node, and a drain coupled to the second clock terminal.

The first clock terminal may be configured to receive the second initialization signal. The second clock terminal may be configured to receive the first initialization signal. The output terminal may be configured to provide the one of the first scan signals. The data terminal of a first stage of the plurality of sequentially-connected stages may be configured to receive a starting signal. The data terminal of each next stage of the plurality of sequentially-connected stages may be configured to receive the one of the first-scan signals of a corresponding previous stage of the plurality of sequentially-connected stages.

The output terminal may be configured to output a low level when the second node is a low level and the first initialization signal is a low level.

The sub-driver unit may include a plurality of sub-drivers corresponding to the plurality of second-scan lines in the scan block. The common driver may be configured to supply the one of the first-scan signals commonly to each of the sub-drivers. Each of the sub-drivers may be configured to provide a corresponding second-scan signal of the ones of the second-scan signals to a corresponding one of the second-scan lines of the scan block in response to the one of the first-scan signals, one of the output enable signals, and the one of the first initialization signal and the second initialization signal.

Each of the sub-drivers may have a same configuration as the common driver.

The ones of the second-scan signals of the stage may overlap the one of the first-scan signals of a corresponding next stage of the plurality of sequentially-connected stages.

The signal generator may be further configured to generate a third driving control signal to control the emission driver and a power control signal to control the power supply based on the input control signal.

Each of the pixels may include: a switching transistor including a first terminal coupled to one of the data lines, a gate terminal coupled to one of the second-scan lines, and a second terminal coupled to a first node; a storage capacitor connected between the high power supply voltage and a second node; a driving transistor including a first terminal coupled to the first node, a gate terminal coupled to the second node, and a second terminal coupled to a third node; a compensation transistor including a first terminal coupled to the second node, a gate terminal coupled to the one of the second-scan lines, and a second terminal coupled to the third node; an initialization transistor including a first terminal coupled to the second node, a gate terminal coupled to one of the first-scan lines, and a second terminal coupled to the initialization voltage; a discharge transistor including a first terminal coupled to the initialization voltage, a gate terminal coupled to the one of the second-scan lines, and a second terminal coupled to a fourth node; a first emission transistor including a first terminal coupled to the high power supply voltage, a gate terminal configured to receive an emission control signal, and a second terminal coupled to the first node; a second emission transistor including a first terminal coupled to the third node, a gate terminal configured to receive the emission control signal, and a second terminal coupled to the fourth node; and an OLED connected between the fourth node and the low power supply voltage.

The compensation transistor may be configured to diode-connect the driving transistor in response to one of the second-scan signals being supplied to the one of the second-scan lines.

The initialization transistor may be configured to transfer the initialization voltage to the gate terminal of the driving transistor in response to a corresponding one of the first-scan signals being supplied to the one of the first-scan lines to initialize a data voltage transferred to the driving transistor during a previous frame. The discharge transistor may be configured to discharge a parasitic capacitance between the second emission transistor and the OLED in response to one of the second-scan signals being supplied to the one of the second-scan lines.

According to yet another embodiment of the present invention, a display system is provided. The display system includes: an application processor configured to generate image data and an input control signal; and an organic light emitting diode (OLED) display device configured to display the image data in response to the input control signal. The OLED display device includes: a display panel including a plurality of pixels; a driving circuit connected to the pixels through a plurality of scan blocks and a plurality of data lines, each of the scan blocks including a plurality of first-scan lines and a plurality of second-scan lines, the driving circuit being configured to provide first-scan signals to the first-scan lines of each of the scan blocks, to serially provide second-scan signals to the second-scan lines of each of the scan blocks, to provide data voltages to the data lines, and to adjust the serial providing of the second-scan signals to the second-scan lines of each of the scan blocks to lessen a number of transitions of the data voltages of the data lines compared to a sequential providing of the second-scan signals to the second-scan lines in each of the scan blocks; and a power supply to supply a low power supply voltage, a high power supply voltage, and an initialization voltage to the display panel.

According to embodiments of the present invention, scan lines of an OLED display device include first-scan lines and second-scan lines, and a scan driver of the OLED display device provides first-scan signals in common to the first-scan lines of each of a plurality of scan blocks, and provides second-scan signals serially to the second-scan lines of each scan block in such an order that the number of transitions of data voltages provided to the pixels coupled to the scan block is reduced or minimized. Therefore, power consumption may be reduced.

BRIEF DESCRIPTION OF THE DRAWINGS

Illustrative, non-limiting example embodiments of the present invention will be more clearly understood from the following detailed description taken in conjunction with the accompanying drawings.

DETAILED DESCRIPTION

Figure 1:
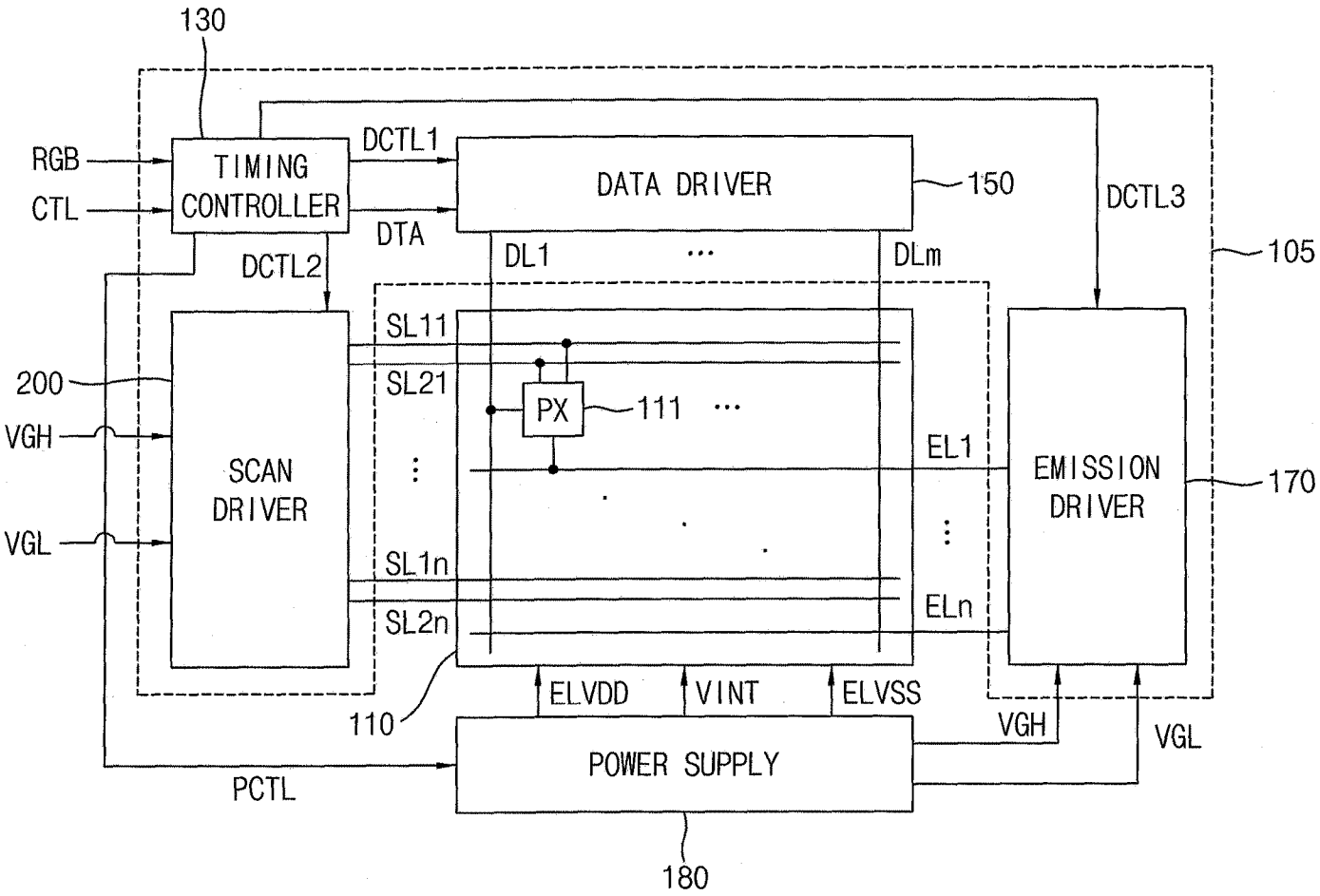
FIG. 1 is a block diagram illustrating an organic light emitting diode (OLED) display device according to an embodiment of the present invention.

Example embodiments of the present invention are described more fully hereinafter with reference to the accompanying drawings. The invention may, however, be embodied in many different forms and should not be construed as limited to the embodiments set forth herein.

It will be understood that when an element or layer is referred to as being "on," "connected to," or "coupled to" another element or layer, it can be directly on, connected to, or coupled to the other element or layer, or intervening elements or layers may be present. In contrast, when an element is referred to as being "directly on," "directly connected to," or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third, etc., may be used herein to describe various elements, components, regions, layers, patterns, and/or sections, these elements, components, regions, layers, patterns, and/or sections should not be limited by these terms.

The terminology used herein is for the purpose of describing particular example embodiments only and is not intended to be limiting of the present invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the present invention are described herein with reference to cross sectional illustrations that are schematic illustrations of illustratively idealized embodiments and intermediate structures. As such, variations from the shapes of the illustrations as a result, for example, of manufacturing techniques and/or tolerances, are to be expected as would be apparent to one of ordinary skill. Thus, embodiments of the present invention should not be construed as limited to the particular shapes of regions illustrated herein but may also include variations in shapes that result, for example, from manufacturing. The regions illustrated in the figures are schematic in nature and their shapes are not intended to limit the scope of the invention.

Unless otherwise defined, all terms (including technical and scientific terms) used herein have the same meaning as commonly understood by one of ordinary skill in the art to which the present invention belongs. It will be further understood that terms such as those defined in commonly used dictionaries should be interpreted as having a meaning that is consistent with their meaning in the context of the relevant art and will not be interpreted in an idealized or overly formal sense unless expressly so defined herein.

The electronic or electric devices and/or any other relevant devices or components according to embodiments of the present invention described herein may be implemented utilizing any suitable hardware, firmware (e.g., an application-specific integrated circuit, or ASIC), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, microprocessors, etc., in one or more computing devices, executing computer program instructions and interacting with other system components for performing the various functionalities described herein. The computer program instructions are stored in a memory, which may be implemented, in a computing device using a standard memory device, such as, for example, a random access memory (RAM). The computer program instructions may also be stored in other non-transitory computer readable media such as, for example, a CD-ROM, flash drive, or the like. In addition, a person of skill in the art should recognize that the functionality of various computing devices may be combined or integrated into a single computing device, or the functionality of a particular computing device may be distributed across one or more other computing devices without departing from the spirit and scope of the present invention.

Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

FIG. 1 is a block diagram illustrating an organic light emitting diode (OLED) display device 100 according to an embodiment of the present invention.

Referring to FIG. 1, the OLED display device 100 may include a driving circuit 105, a display panel 110, and a power supply 180. The driving circuit 105 may include a timing controller 130, a data driver 150, a scan driver 200, and an emission driver 170. In another embodiment, the OLED display device 100 may further include a mode signal generator. The timing controller 130, the data driver 150, the scan driver 200, and the emission driver 170 may be coupled to the display panel 110 by, for example, a chip-on flexible printed circuit (COF), a chip-on glass (COG), a flexible printed circuit (FPC), etc.

The display panel 110 may be coupled to the scan driver 200 of the driving circuit 105 through a first group of scan lines (first-scan lines) SL11-SL1*n* (n is an integer greater than three) and a second group of scan lines (second-scan lines) SL21-SL2*n*, may be coupled to the data driver 150 through a plurality of data lines DL1-DLm (m is an integer greater than three), and may be coupled to the emission driver 170 of the driving circuit 220 through a plurality of emission control lines EL1-ELn. The display panel 110 may include a plurality of pixels 111, and each pixel 111 is disposed at a crossing region of a corresponding one of the first group of scan lines SL11-SL1*n*, a corresponding one of the second group of scan lines SL21-SL2*n*, a corresponding one of the data lines DL1-DLm, and a corresponding one of the emission control lines EL1-ELn.

The first group of scan lines SL11-SL1*n* and the second group of scan lines SL21-SL2*n* may be referred to as a plurality of scan lines SL1-SLn, with first scan line SL1 including (first) first-scan line SL11 and (first) second-scan line SL21, second scan line SL2 including (second) first-scan line SL12 and (second) second-scan line SL22, third scan line SL3 including (third) first-scan line SL13 and (third) second-scan line SL23, etc. In addition, the scan lines SL1-SLn may be arranged in scan blocks, such as scan blocks of p scan lines (p greater than or equal to 2) each, a first scan block SB1 including first-scan lines SL11-SL1*p* and second-scan lines SL21-SL2*p*, a second scan block SB2 including first-scan lines SL1(*p*+1)-SL1(2p) and second-scan lines SL2(*p*+1)-SL2(2p), etc.

The power supply 180 may provide a high power supply voltage ELVDD, a low power supply voltage ELVSS (where ELVDD is a higher voltage than ELVSS), and an initialization voltage VINT to the display panel 110. The power supply 180 may also provide a first voltage VGH and a second voltage VGL (where the first voltage VGH is a higher voltage than the second voltage VGL) to the emission driver 170 and the scan driver 200.

The scan driver 200 may supply a first-scan signal and a second-scan signal to each of the pixels 111 through the first group of scan lines SL11-SL1*n* and the second group of scan lines SL21-SL2*n*, respectively, based on a second driving control signal DCTL2. For example, the scan driver 200 may supply a first-scan signal in common to each of the first-scan lines of a scan block followed by a second-scan signal to each of the second-scan lines of the scan block, the second-scan signals being applied sequentially or serially to respective ones of the second-scan lines.

For instance, the second-scan lines may be driven at a rate of one second-scan line per horizontal period, the horizontal period corresponding to the concurrent supplying of a data signal to each of the first through mth data lines DL1-DLm, the data signals controlling the respective luminance of the pixels coupled to the corresponding second-scan line being driven during the horizontal period. The first-scan signals may be, for example, initialization signals to initialize the pixel circuits (e.g., for all the pixels connected to the scan block) and the second-scan signals may be select signals to synchronize the delivery of data voltages via the data lines to the corresponding pixels of each second-scan line.

The data signals are concurrently supplied to the first through mth data lines DL1-DLm each horizontal period. Each data signal may correspond to a data voltage associated with a particular luminance for the target pixel. Consecutive data signals to the same data line may cause a data voltage transition if the corresponding voltage levels of the data signals are sufficiently distinct. For example, the data voltages may represent digital driving signals swinging between two voltage levels (representing 0 and 1). Data voltage transitions result in increased power consumption of the OLED display device.

The scan driver 200 may supply the first-scan signal in common to first-scan lines of each scan block and the second-scan signals serially to second-scan lines of each scan block in such an order that the number of transitions of data voltages provided to the pixels coupled to each scan block is reduced or minimized. For example, the order of driving the second-scan lines (with second-scan signals) and the order of supplying the corresponding data signals to the first through mth data lines DL1-DLm may be adjusted to reduce or minimize the resulting number of data voltage transitions, as will be described in more detail below. The first group of scan lines SL11-SL1*n* and the second group of scan lines SL21-SL2*n* may be grouped into a plurality of scan blocks.

The data driver 150 may supply a data voltage to each of the pixels 111 through the plurality of data lines DL1-DLm based on a first driving control signal DCTL1. The data driver 150 may supply a data voltage corresponding to data signals DTA to each of the pixels 111 through the plurality of data lines DL1-DLm in such an order to coincide (e.g., synchronize) with the corresponding order of the second-scan signals that the number of transitions of data voltage provided to pixels coupled to each scan block is reduced or minimized.

The emission driver 170 may supply an emission control signal to each of the pixels 111 through the plurality of emission control lines EL1-ELn based on a third driving control signal DCTL3. Luminance of the display panel 110 may be adjusted based on the emission control signal.

The power supply 180 may provide the high power supply voltage ELVDD, the low power supply voltage ELVSS, and the initialization voltage VINT to the display panel 110, and may provide the first voltage VGH and the second voltage VGL to the emission driver 170 and the scan driver in response; to a power control signal PCTL.

The timing controller 130 may receive input image data RGB, an input control signal CTL, and a mode signal, and may generate the first through third driving control signals DCTL1-DCTL3 and the power control signal PCTL based on the input control signal CTL. The timing controller 130 may provide the first driving control signal DCTL1 to the data driver 150, the second driving control signal DCTL2 to the scan driver 200, the third driving control signal DCTL3 to the emission driver 170, and the power control signal PCTL to the power supply 180. The timing controller 130 may receive the input image data RGB and arrange the input image data RGB such that the number of transitions of data voltage provided to pixels coupled to each scan block is reduced or minimized to provide the data signals DTA to the data driver 150.

Figure 2:
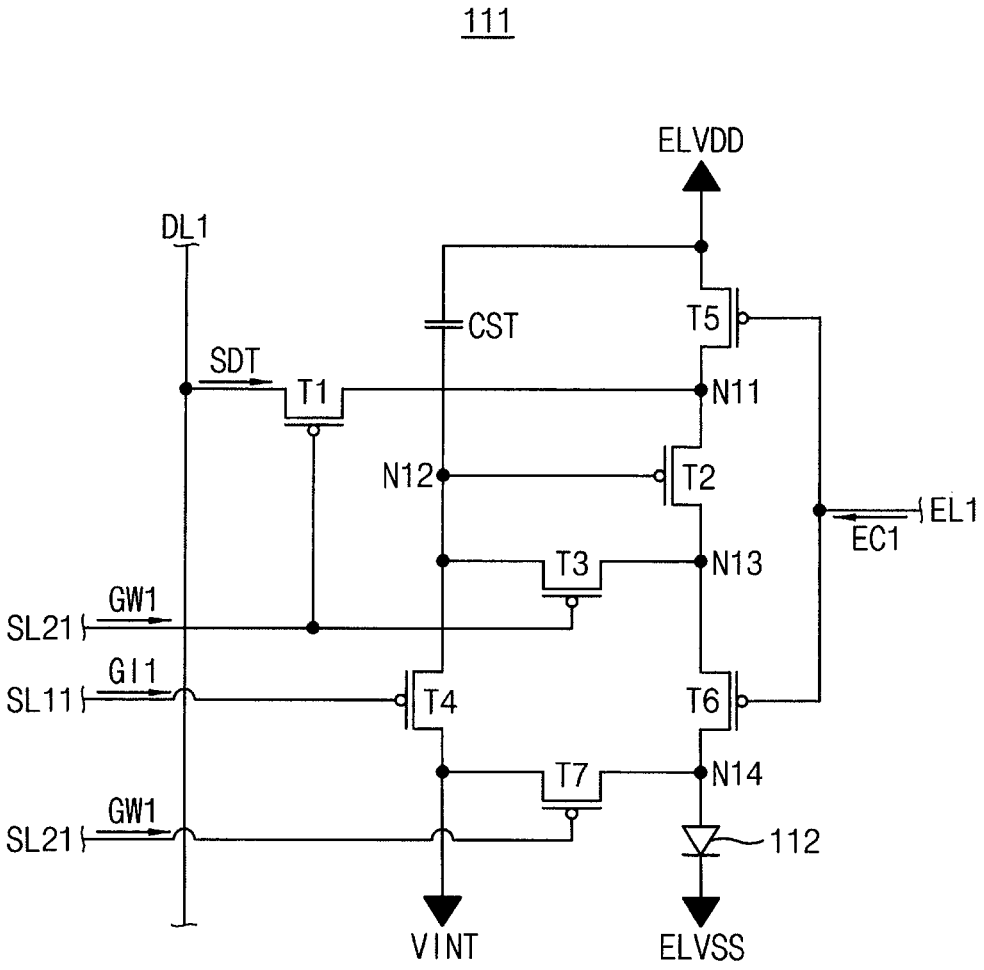
FIG. 2 is a circuit diagram illustrating an example pixel in the OLED display device of FIG. 1 according to an embodiment of the present invention.

FIG. 2 is a circuit diagram illustrating an example pixel 111 in the OLED display device of FIG. 1 according to an embodiment of the present invention.

In FIG. 2, the pixel 111 is coupled to a first data line DL1, a (first) first-scan line SL11, a (first) second-scan line SL21, and a first emission control line EL1. The pixel 111 may be coupled to the scan driver 200 through the (first) first-scan line SL11 of the first group of scan lines SL11-SL1*n* and the (first) second-scan line SL21 of the second group of scan lines SL21-SL2*n*, may be coupled to the data driver 150 through the first data line DL1 of the data lines DL1-DLm, and may be coupled to the emission driver 170 through the first emission control line EL1 of the emission control lines EL1-ELn.

The pixel 111 may include a switching transistor T1, a driving transistor T2, a compensation transistor T3, an initialization transistor T4, first and second emission transistors T5 and T6, a discharge transistor T7, a storage capacitor CST, and an OLED 112. The switching transistor T1 may include a p-channel metal-oxide semiconductor (PMOS) transistor that has a first terminal coupled to the first data line DL1 to receive a data voltage SDT, a gate terminal coupled to the (first) second-scan line SL21 to receive a (first) second-scan signal GW1, and a second terminal coupled to a first node N11. The driving transistor T2 may include a PMOS transistor that has a first terminal coupled to the first node N11, a gate terminal coupled to a second node N12, and a second terminal coupled to a third node N13.

The compensation transistor T3 may include a PMOS transistor that has a gate terminal coupled to the (first) second-scan line SL21 to receive the (first) second-scan signal GW1, a first terminal coupled to the second node N12, and a second terminal coupled to the third node N13. The initialization transistor T4 may include a PMOS transistor that has a gate terminal coupled to the (first) first-scan line SL11 to receive a (first) first-scan signal GI1, a first terminal coupled to the second node N12, and a second terminal receiving the initialization voltage VINT.

The first emission transistor T5 may include a PMOS transistor that has a first terminal coupled to the high power supply voltage ELVDD, a second terminal coupled to the first node N11, and a gate terminal coupled to the first emission control line EL1 to receive the first emission control signal EC1. The second emission transistor T6 may include a PMOS transistor that has a first terminal coupled to the third node N13, a second terminal coupled to a fourth node N14, and a gate terminal coupled to the first emission control line EL1 to receive the first emission control signal EC1. The storage capacitor CST may have a first terminal coupled to the high power supply voltage ELVDD and a second terminal coupled to the second node N12. The OLED 112 may have an anode electrode coupled to the fourth node N14 and a cathode electrode coupled to the low power supply voltage ELVSS.

The discharge transistor T7 may have a PMOS transistor that has a first terminal coupled to the initialization voltage VINT, a second terminal coupled to the fourth node N14, and a gate terminal coupled to the (first) second-scan line SL21 to receive the (first) second-scan signal GW1.

The switching transistor T1 transfers the data voltage SDT to the storage capacitor CST in response to the (first) second-scan signal GW1 and the OLED 112 may emit light in response to the data voltage SDT stored in the storage capacitor CST to display an image.

In an embodiment of the present invention, the pixels 111 of the display panel 110 may be driven using a digital driving method. For example, in the digital driving method, data voltages may take on one of two values, representing on and off. In the digital driving method of the pixel, the driving transistor T2 may operate as a switch in a linear region. Accordingly, the driving transistor T2 may represent one of a turn-on state and a turn-off state.

To turn on or turn off the driving transistor T2, the data voltage SDT has two levels including a turn-on level and a turn-off level. In the digital driving method, the pixel represents one of the turn-on state and the turn-off state so that a single frame may be divided into a plurality of subfields to represent various gray levels. The turn-on status and the turn-off status of the pixel during each of the subfields are combined so that the various gray levels of the pixel may be represented. By way of example, the subfields may each represent a different length or weight (such as different powers of two), that may be combined in any combination to realize all the different gray levels.

The first and second emission transistors T5 and T6 are turned on or turned off in response to the first emission control signal EC1 to provide a current to the OLED 112 or to block or intercept a current from the OLED 112. When the current is blocked or intercepted from the OLED 112, the OLED 112 does not emit light. Therefore, the first and second emission transistors T5 and T6 are turned on or turned off in response to the first emission control signal EC1 to adjust a luminance of the display panel 110.

The compensation transistor T3 may connect the second node N12 and the third node N13 in response to the (first) second-scan signal GW1. The compensation transistor T3 may compensate for variance of the threshold voltage of the driving transistor of each pixel 111 when the image is displayed by diode-connecting the gate terminal and the second terminal of the driving transistor T2.

The initialization transistor T4 may transfer the initialization voltage VINT to the second node N12 in response to the (first) first-scan signal GI1. The initialization transistor T4 may initialize the data voltage transferred to the driving transistor T2 during a previous frame by transferring the initialization voltage VINT to the gate terminal of the driving transistor T2.

The discharge transistor T7 connects the fourth node N14 to the initialization voltage VINT in response to the (first) second-scan signal GW1 to discharge parasitic capacitance between the second emission transistor T6 and the OLED 112. In other embodiments, the (first) first-scan signal Gil may be supplied to the gate terminal of the discharge transistor T7 instead of the (first) second-scan signal GW1.

Figure 3:
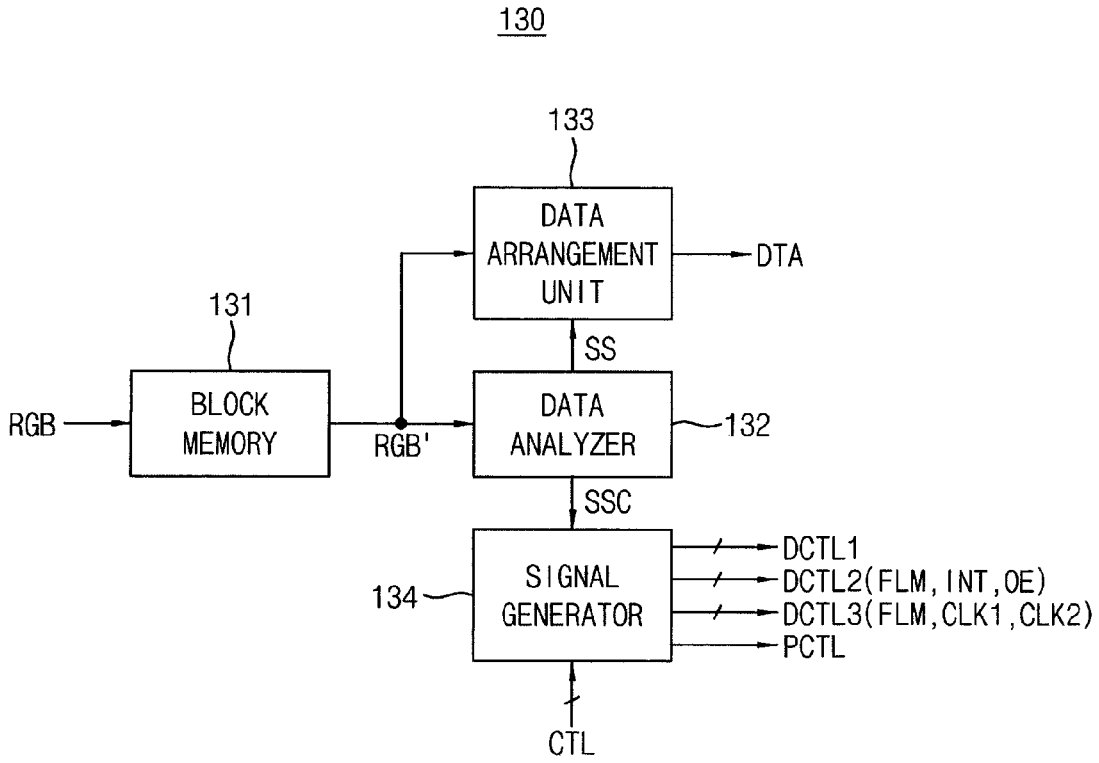
FIG. 3 is a block diagram illustrating an example timing controller in the OLED display device of FIG. 1 according to an embodiment of the present invention.

FIG. 3 is a block diagram illustrating an example timing controller 130 in the OLED display device 100 of FIG. 1 according to an embodiment of the present invention.

Referring to FIG. 3, the timing controller 130 may include a block memory 131, a data analyzer 132, a data arrangement unit 133, and a signal generator 134. The block memory 131 may store the input image data RGB on a scan block basis (e.g., the input image data RGB for one or more scan blocks at a time), and data on the scan block basis is provided to the pixels connected to each scan block. The data analyzer 132 analyzes transitions of first image data RGB' on a scan block basis, stored in the block memory 131, and generates a scan sequence signal SS and a scan sequence control signal SSC that render the number of data voltage transitions of the first image data RGB' to be reduced or minimized.

For example, the data analyzer may analyze the number of data voltage transitions that take place for each of the different arrangements of serially driving the second-scan lines (e.g., one by one) with the first image data RGB', possibly including the last data signals transmitted for the previous scan block (or even the first data signals to be transmitted for the next scan block), and select the arrangement that produces the fewest data voltage transitions. The block memory 131 may be an electronic memory, such as RAM or ROM, and may be a dedicated component or combined other electronic processing components.

The data analyzer 132 may provide the scan sequence signal SS to the data arrangement unit 133 and the scan sequence control signal SSC to the signal generator 134. The data analyzer 132 may analyze grey levels of the first image data RGB' per each data line to generate the scan sequence signal SS and the scan sequence control signal SSC that render the number of transitions of the first image data RGB' to be reduced or minimized.

The data arrangement unit 133 receives the first image data RGB' on the scan block basis, rearranges the first image data RGB' according to the scan sequence signal SS such that the number of the data voltage transitions of the first image data RGB' is reduced or minimized, and outputs the data signals DTA. To this and other computational ends, the data arrangement unit 133 and other electronic devices, such as the data analyzer 132 and the signal generator 134, may be implemented by shared or dedicated computing devices, such as processors, microprocessors, ASICs, etc., as would be apparent to one of ordinary skill.

The signal generator 134 may generate the first driving control signal DCTL1 that controls the data driver 150 and the second driving control signal DCTL2 that controls the scan driver 200 based on the input control signal CTL and the scan sequence control signal SSC. The signal generator 134 may generate the third driving control signal DCTL3 that controls the emission driver 170 and the power control signal PCTL that controls the power supply 180 in response to the input control signal CTL. The second driving control signal DCTL2 may include a starting signal FLM (frame line mark), a plurality of initialization signals INT, and a plurality of output enable signals OE. The third driving control signal DCTL3 may include a starting signal FLM (frame line mark), a first clock signal CLK1, and a second clock signal CLK2.

Figure 4:
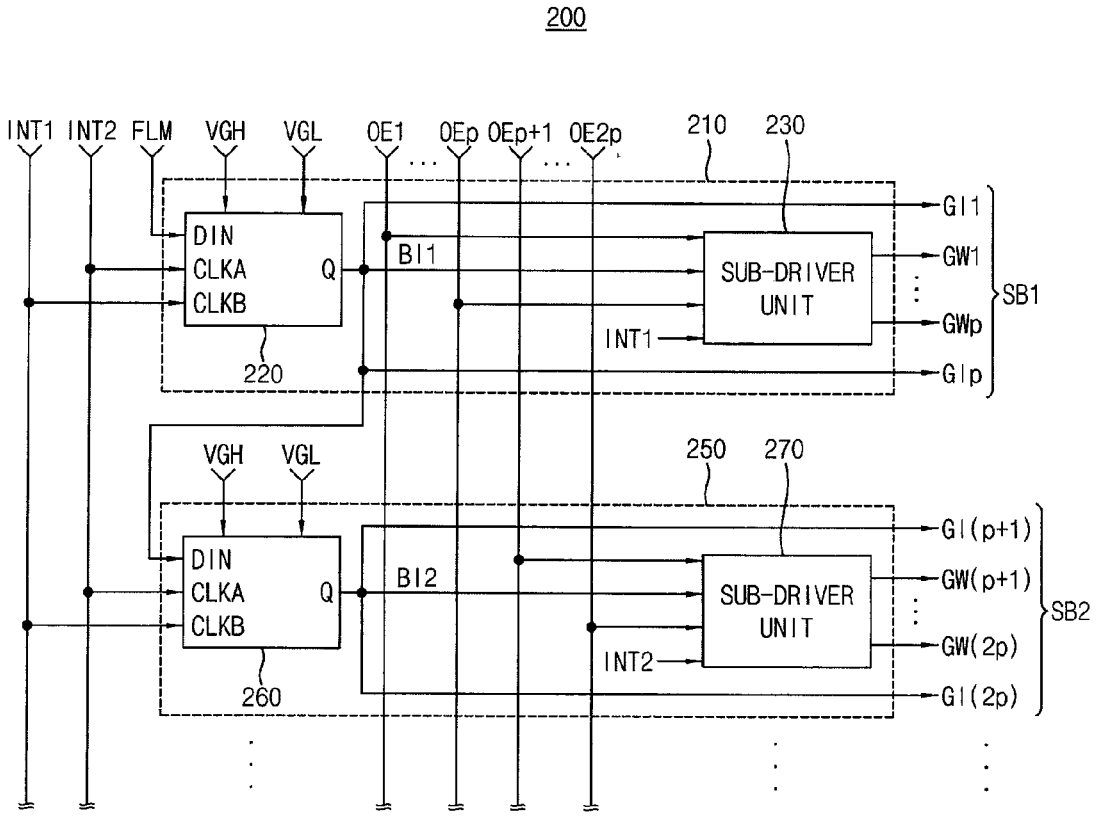
FIG. 4 is a block diagram illustrating an example scan driver in the OLED display device of FIG. 1 according to an embodiment of the present invention.

FIG. 4 is a block diagram illustrating an example scan driver 200 in the OLED display device 100 of FIG. 1 according to an embodiment of the present invention.

Referring to FIGS. 1 and 4, the scan driver 200 may include a plurality of stages 210, 250, . . . , coupled to the pixels 111 through the first group of scan lines SL11-SL1*n* and the second group of scan lines SL21-SL2*n*, the stages being connected to each other one after another (e.g., sequentially-connected stages). The stages 210, 250, . . . , may respectively include common drivers 220, 260, . . . , and sub-driver units 230, 270, . . . . The stages 210, 250, . . . , may represent corresponding scan blocks SB1, SB2, . . . , of the scan lines The first common driver 220 is part of the first stage 210 and may provide (e.g., concurrently provide) a first block initialization signal BI1 as (first) through (pth) first-scan signals GI1-GIp (p is an integer greater than one representing the scan block size) commonly to (first) through (pth) first-scan lines SL11-SL1*p* of the first scan block SB1 in response to a first initialization signal INT1, a second initialization signal INT2, and a starting signal FLM. For example, the first block initialization signal BI1 may be a common first-scan signal to the (first) through (pth) first-scan lines SL11-SL1*p*.

The first sub-driver unit 230 is also part of the first stage 210 and may provide (e.g., serially provide) (first) through (pth) second-scan signals GW1-GWp to (first) through (pth) second-scan lines SL21-SL2*p* of the first scan block SB1 in response to first through pth output enable signals OE1-OEp, the first block initialization signal BI1, and the first initialization signal INT1 such that the number of transitions of data voltages provided to the pixels coupled to the first scan block SB1 is reduced or minimized. In some embodiments, the serial providing of the (first) through (pth) second-scan signals GW1-GWp to the (first) through (pth) second-scan lines SL21-SL2*p* takes place after the concurrent providing of the common first-scan signal (e.g., the first block initialization signal BI1) to the (first) through (pth) first-scan lines SL11-SL1*p*.

For example, an order of the serial providing of the (first) through (pth) second-scan signals GW1-GWp to the (first) through (pth) second-scan lines SL21-SL2*p* may be dynamically configurable based on the first through pth output enable signals OE1-OEp. In some embodiments, the order of the providing of the (first) through (pth) second-scan signals GW1-GWp to the (first) through (pth) second-scan lines SL21-SL2*p* may be adjusted to lessen the number of data voltage transitions provided to the data lines compared to a sequential providing of the (first) through (pth) second-scan signals GW1-GWp to the (first) through (pth) second-scan lines SL21-SL2*p*.

The second common driver 260 is part of the second stage 250 and may provide a second block initialization signal BI2 as ((p+1)th) through ((2p)th) first-scan signals GI(p+1)-GI(2p) commonly to ((p+1)th) through ((2p)th) first-scan lines SL1(*p*+1)-SL1(2p) of the second scan block SB2 in response to the first initialization signal INT1, the second initialization signal INT2, and the first block initialization signal BI1. The second sub-driver unit 270 is also part of the second stage 250 and may provide ((p+1)th) through ((2p)th) second-scan signals GW(p+1)-GW(2p) to ((p+1)th) through ((2p)th) second-scan lines SL2(*p*+1)-SL2(2p) of the second scan block SB2 in response to the ((p+1)th) through ((2p)th) output enable signals OE(p+1)-OE(2p), the second block initialization signal BI2, and the second initialization signal INT2 such that the number of transitions of data voltages provided to the pixels coupled to the second scan block SB2 is reduced or minimized.

Each of the first and second sub-driver units 230 and 270 may include a plurality of sub-drivers corresponding to the number of the second-scan lines in each of the first and second scan blocks SB1 and SB2.

Figure 5:
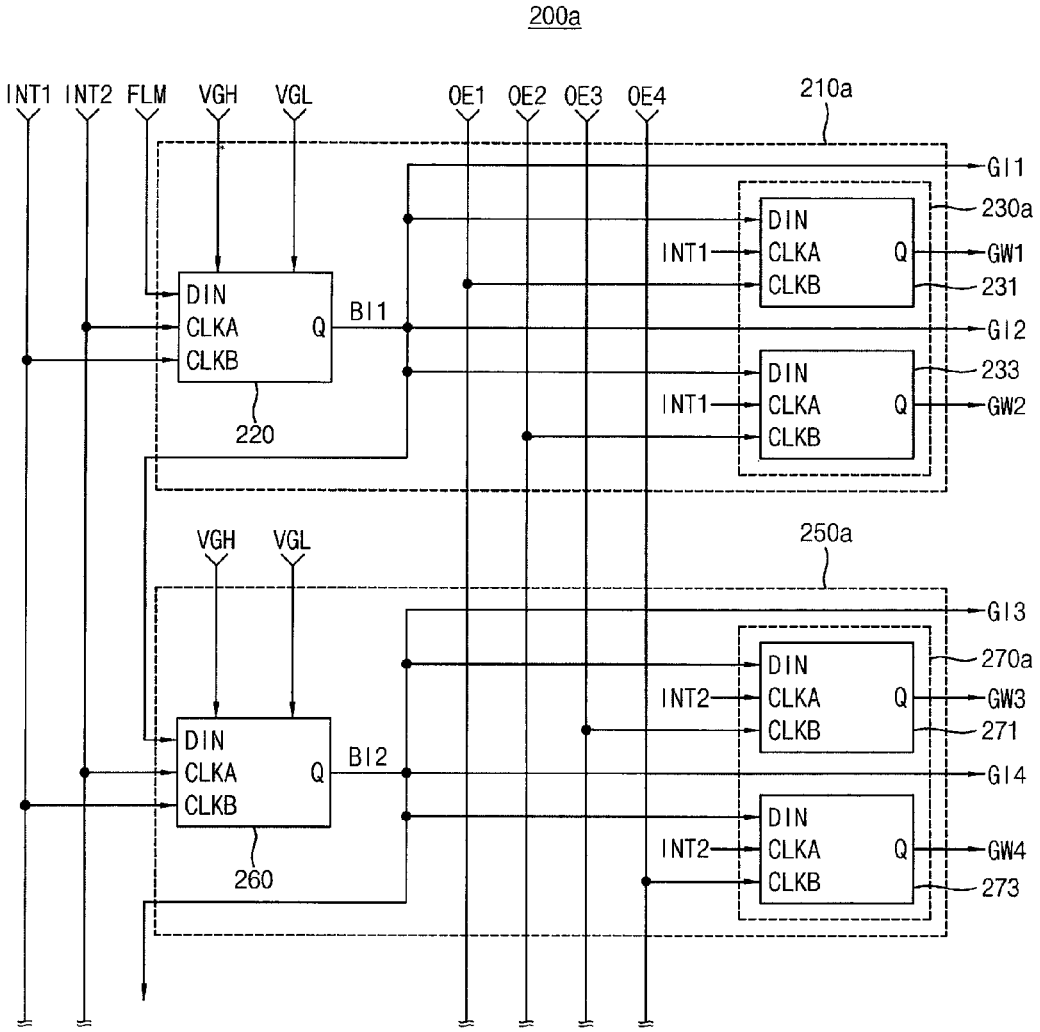
FIG. 5 illustrates an example scan driver of the scan driver of FIG. 4 according to an embodiment of the present invention.

FIG. 5 illustrates an example scan driver 200*a* of the scan driver 200 of FIG. 4 according to an embodiment of the present invention.

In FIG. 5, it is assumed that the first group of scan lines SL11-SL1*n* and the second group of scan lines SL21-SL2*n* are grouped into a plurality of scan blocks and each scan block include two first-scan lines and two second-scan lines. Referring to FIGS. 1 and 5, the scan driver 200*a* may include a plurality of stages 210*a*, 250*a*, . . . , coupled to the pixels 111 through the first group of scan lines SL11-SL1*n* and the second group of scan lines SL21-SL2*n*, which are sequentially arranged. The stages 210*a*, 250*a*, . . . , may include common drivers 220, 260, . . . , and sub-driver units 230*a*, 270*a*, . . . , respectively. The first sub-driver unit 230*a* may include first and second sub-drivers 231 and 233 and the second sub-driver unit 270*a* may include third and fourth sub-drivers 271 and 273.

The first common driver 220 is part of the first stage 210*a* and may provide a first block initialization signal BI1 as (first) and (second) first-scan signals GI1 and GI2 commonly to the (first) and (second) first-scan lines SL11 and SL12 of a first scan block SB1 in response to the first initialization signal INT1, the second initialization signal INT2, and the starting signal FLM. The first sub-driver unit 230*a* is also part of the first stage 210*a* and may respectively provide (first) and (second) second-scan signals GW1 and GW2 to the (first) and (second) second-scan lines SL21 and SL22 of the first scan block SB1 in response to the first and second output enable signals OE1-OE2, the first block initialization signal BI1, and the first initialization signal INT1.

The first sub-driver unit 230*a* may include the first and second sub-drivers 231 and 233. The first sub-driver 231 may provide the (first) second-scan signal GW1 to the (first) second-scan line SL21 of the first scan block SB1 in response to the first output enable signal OE1, the first block initialization signal BI1, and the first initialization signal INT1, and the second sub-driver 233 may provide the (second) second-scan signal GW2 to the (second) second-scan line SL22 of the first scan block SB1 in response to the second output enable signal OE2, the first block initialization signal BI1, and the first initialization signal INT1.

The second common driver 260 is part of the second stage 250*a* and may provide a second block initialization signal BI2 as (third) and (fourth) first-scan signals GI3 and GI4 commonly to the (third) and (fourth) first-scan lines SL13 and SL14 of a second scan block SB2 in response to the first initialization signal INT1, the second initialization signal INT2, and the first block initialization signal BI1. The second sub-driver unit 270*a* is also part of the second stage 250*a* and may respectively provide (third) and (fourth) second-scan signals GW3 and GW4 to the (third) and (fourth) second-scan lines SL23 and SL24 of the second scan block SB2 in response to the third and fourth output enable signals OE3-OE4, the second block initialization signal BI2, and the second initialization signal INT2.

The second sub-driver unit 270*a* may include the third and fourth sub-drivers 271 and 273. The third sub-driver 271 may provide the (third) second-scan signal GW3 to the (third) second-scan line SL23 of the second scan block SB2 in response to the third output enable signal OE3, the second block initialization signal BI2, and the second initialization signal INT2, and the fourth sub-driver 273 may provide the (fourth) second-scan signal GW4 to the (fourth) second-scan line SL24 of the second scan block SB2 in response to the fourth output enable signal OE4, the second block initialization signal BI2, and the second initialization signal INT2.

Figure 6:
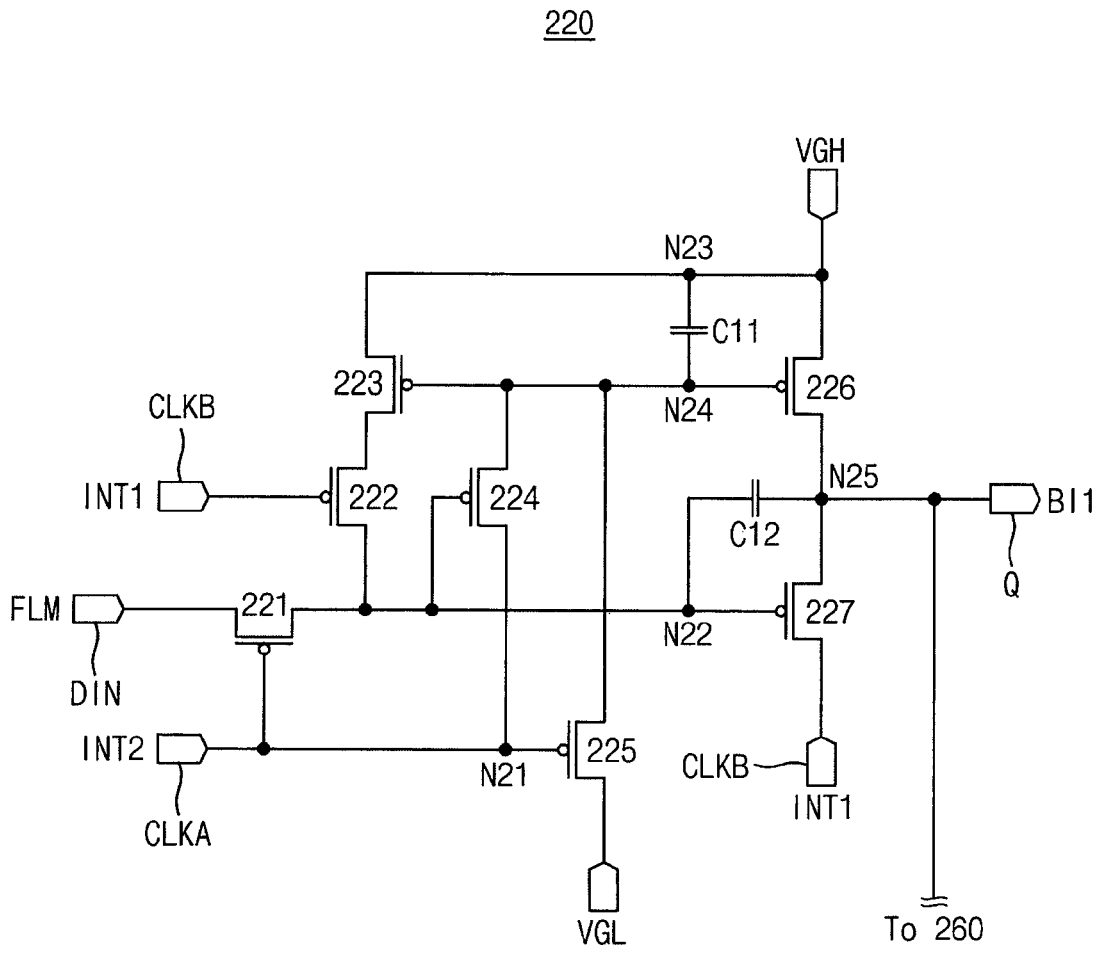
FIG. 6 illustrates an example common driver in the scan driver of FIG. 5 according to an embodiment of the present invention.

FIG. 6 illustrates an example common driver 220 in the scan driver 200*a* of FIG. 5 according to an embodiment of the present invention.

In FIG. 5, each of the first and second sub-drivers 231 and 233 as well as the second common driver 260 and the third and fourth sub-drivers 271 and 273 may have substantially a same configuration as the first common driver 220. Referring to FIG. 6, the common driver 220 may include first through seventh PMOS transistors 221-227 and first and second capacitors C11 and C12.

The first PMOS transistor 221 has a source coupled to a data terminal DIN, a gate coupled to a first node N21 coupled to a first clock terminal CLKA, and a drain coupled to a second node N22. The second PMOS transistor 222 has a gate coupled to a second clock terminal CLKB and a drain coupled to the second node N22. The third PMOS transistor 223 has a drain coupled to a source of the second PMOS transistor 222, a source coupled to a third node N23 receiving a first voltage VGH, and a gate coupled to a fourth node N24. The first capacitor C11 is coupled between the third node N23 and the fourth node N24.

The fourth PMOS transistor 224 has a gate coupled to the second node N22, a drain coupled to the first node N21, and a source coupled to the fourth node N24. The fifth PMOS transistor 225 has a source coupled to the fourth node N24, a gate coupled to the first node N21, and a drain receiving a second voltage VGL. The sixth PMOS transistor 226 has a source coupled to the third node N23, a gate coupled to the fourth node N24, and a drain coupled to a fifth node N25 corresponding to an output terminal Q. The second capacitor C12 is coupled between the second node N22 and the fifth node N25. The seventh PMOS transistor 227 has a source coupled to the fifth node N25, a gate coupled to the second node N22, and a drain coupled to the second clock terminal CLKB.

A level of the first voltage VGH is higher than a level of the second voltage VGL. The starting signal FLM is supplied to the data terminal DIN, the second initialization signal INT2 is supplied to the first clock terminal CLKA, the first initialization signal INT1 is supplied to the second clock terminal CLKB, and the first block initialization signal BI1 is provided at the output terminal Q.

Figure 7:
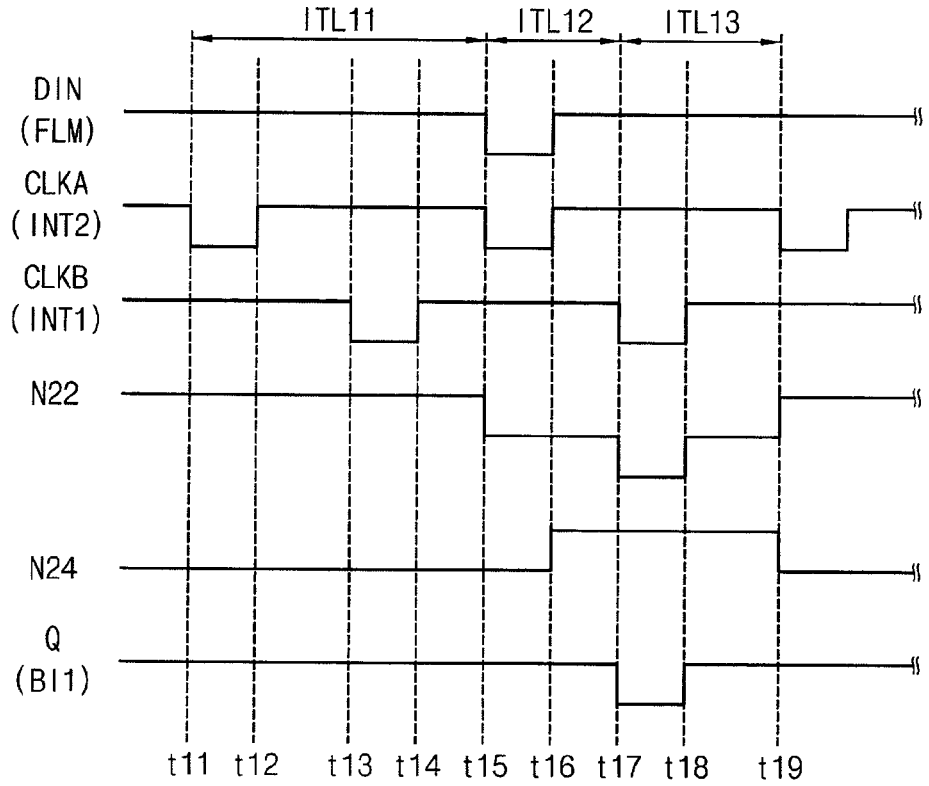
FIG. 7 is a timing diagram illustrating operation of the common driver of FIG. 6.

FIG. 7 is a timing diagram illustrating operation of the common driver 220 of FIG. 6 according to an embodiment of the present invention.

Referring to FIGS. 6 and 7, the starting signal FLM is activated at a low level between times t15-t16, the second initialization signal INT2 is activated between times t11-t12 and t15-t16, the first initialization signal INT1 is activated between times t13-t14 and t17-t18, the fourth node N24 is maintained at a high level between times t16-t19, and the first block initialization signal BI1 at the output terminal Q is activated between times t17-t18.

When the second initialization signal INT2 is activated at a low level, the first PMOS transistor 211 is turned-on, and the logic level of the data terminal DIN (in this case, the starting signal FLM) is transferred to the second node N22. When the second node N22 is low level, the logic level of the second clock terminal CLKB, i.e., the logic level of the first initialization signal INT1, is transferred to the output terminal Q through bootstrapping of the second capacitor C12. When the second node. N22 is low level and the first initialization signal INT1 has a low level, the first block initialization signal BI1 at the output terminal Q is activated at a low level between times t17-t18.

In FIG. 7, a first interval ITL11 between times t11-t15 may correspond to an initialization interval during which the common driver 220 is reset, a second interval ITL12 between times t15-t17 may correspond to a sensing interval during which the starting signal FLM is sensed, and a third interval ITL13 between times t17-t19 may correspond to an output interval during which the first block initialization signal BI1 is output at the output terminal Q. The initialization interval, the sensing interval, and the output interval may be repeated after time t19.

Figure 8:
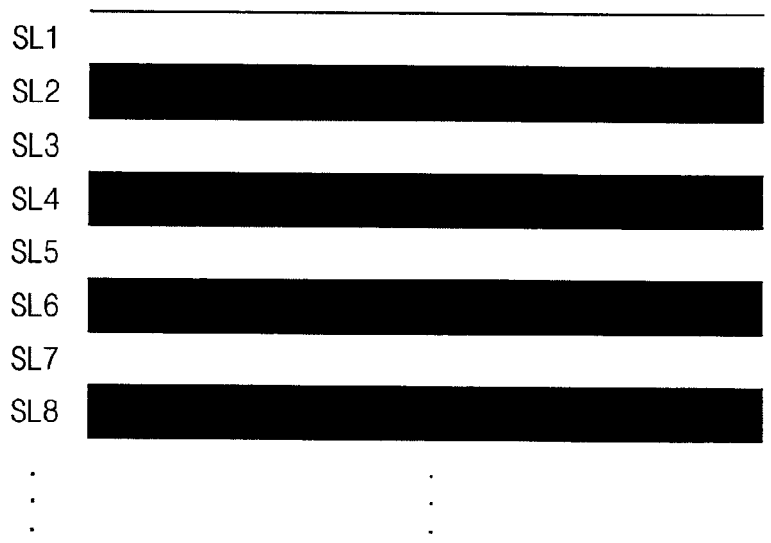
FIG. 8 illustrates an H-stripe (horizontal stripe) pattern displayed in the display panel in FIG. 1 according to an embodiment of the present invention.
Figure 9:
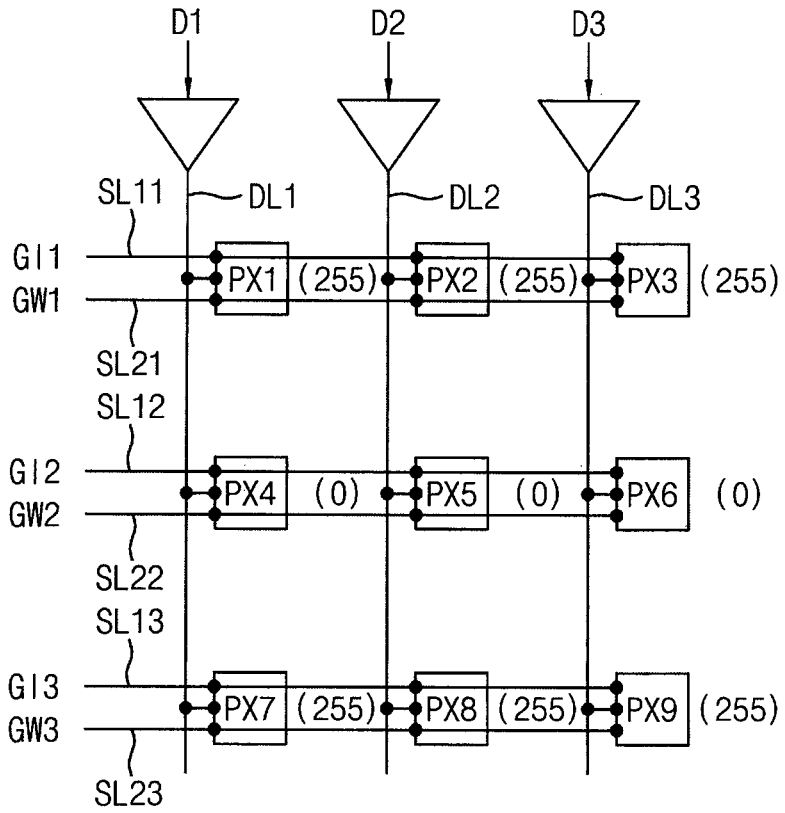
FIG. 9 illustrates gray levels of some pixels when the H-stripe pattern of FIG. 8 is displayed in the display panel in FIG. 1 according to an embodiment of the present invention.

FIG. 8 illustrates an H-stripe (horizontal stripe) pattern displayed in the display panel 110 in FIG. 1 according to an embodiment of the present invention. FIG. 9 illustrates gray levels of some pixels 111 when the H-stripe pattern of FIG. 8 is displayed in the display panel 110 in FIG. 1 according to an embodiment of the present invention. Depending on the implementation of the OLED display device 100 of FIG. 1, the H-stripe pattern may correspond to a set of data voltages being supplied to the data lines DL1, DL2, . . . , that maximizes the number of data voltage transitions.

Referring to FIGS. 8 and 9, a first scan line SL1 may include the (first) first-scan line SL11 and the (first) second-scan line SL21, a second scan line SL2 may include the (second) first-scan line SL12 and the (second) second-scan line SL22, and a third scan line SL3 may include the (third) first-scan line SL13 and the (third) second-scan line SL23. The first scan line SL1 is coupled to the first through third pixels PX1-PX3, the second scan line SL2 is coupled to the fourth through sixth pixels PX4-PX6, and the third scan line SL3 is coupled to the seventh through ninth pixels PX7-PX9.

For displaying the H-stripe pattern, each of the first through third pixels PX1-PX3 is coupled to the (first) first-scan line SL11 and the (first) second-scan line SL21, and may be driven by a data voltage or combination of data voltages that represents 255 gray level, each of the fourth through sixth pixels PX4-PX6 is coupled to the (second) first-scan line SL12 and the (second) second-scan line SL22, and may be driven by a data voltage or combination of data voltages that represents 0 gray level, and each of the seventh through ninth pixels PX7-PX9 is coupled to the (third) first-scan line SL13 and the (third) second-scan line SL23, and may be driven by a data voltage or combination of data voltages that represents 255 gray level.

First data voltages D1 may be sequentially or serially supplied to the first, fourth, and seventh pixels PX1, PX4, and PX7 through the first data line DL1 in accordance with (e.g., in synchronization with) second-scan signals supplied to the (first), (second), and (third) second-scan lines SL21, SL22, and SL23, respectively, second data voltages D2 may be sequentially or serially supplied to the second, fifth, and eighth pixels PX2, PX5, and PX8 through the second data line DL2 in accordance with (e.g., in synchronization with) second-scan signals supplied to the (first), (second), and (third) second-scan lines SL21, SL22, and SL23, respectively, and third data voltages D3 may be sequentially or serially supplied to the third, sixth, and ninth pixels PX3, PX6, and PX9 through the third data line DL3 in accordance with (e.g., in synchronization with) second-scan signals supplied to the (first), (second), and (third) second-scan lines SL21, SL22, and SL23, respectively.

The (first) first-scan signal GI1 is supplied to the first through third pixels PX1-PX3 through the (first) first-scan line SL11 and the (first) second-scan signal GW1 is supplied to the first through third pixels PX1-PX3 through the (first) second-scan line SL21. The (second) first-scan signal GI2 is supplied to the fourth through sixth pixels PX4-PX6 through the (second) first-scan line SL12 and the (second) second-scan signal GW2 is supplied to the fourth through sixth pixels PX4-PX6 through the (second) second-scan line SL22. The (third) first-scan signal GI3 is supplied to the seventh through ninth pixels PX7-PX9 through the (third) first-scan line SL13 and the (third) second-scan signal GW3 is supplied to the seventh through ninth pixels PX7-PX9 through the (third) second-scan line SL23.

Figure 10:
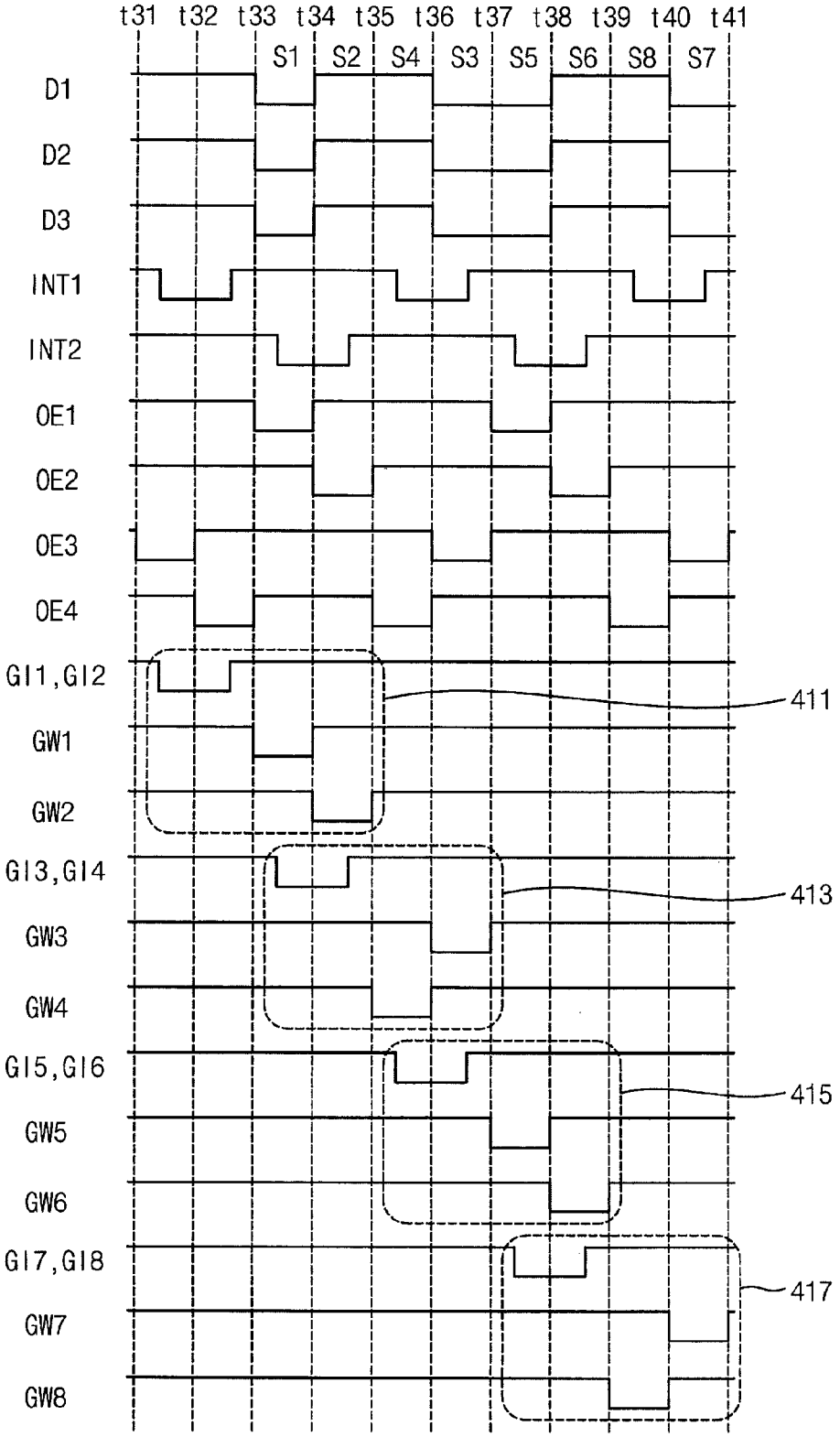
FIG. 10 illustrates an operation of the scan driver of FIG. 5 when the H-stripe pattern of FIG. 8 is displayed in the display panel in FIG. 1 according to an embodiment of the present invention.

FIG. 10 illustrates an operation of the scan driver 200*a* of FIG. 5 when the H-stripe pattern of FIG. 8 is displayed in the display panel 110 in FIG. 1 according to an embodiment of the present invention.

Referring to FIGS. 5 through 10, when the H-stripe pattern of FIG. 8 is displayed in the display panel 110, the data arrangement unit 133 in FIG. 3 rearranges the first through third data voltages D1-D3 such that the number of transitions of data voltages corresponding to the scan block including two scan lines is reduced or minimized, and the signal generator 134 in FIG. 3, according to the rearranged first through third data voltages D1-D3, adjusts activation timings of the first initializing signal INT1, the second initialization signal INT2, and the first through fourth output enable signals OE1-OE4, and provides the scan driver 200*a* with the adjusted first initializing signal INT1, second initialization signal INT2, and first through fourth output enable signals OE1-OE4.

The first initialization signal INT1 is activated at a low level between times t31-t33, t35-t37, and t39-t41, and the second initialization signal INT2 is activated at a low level between times t33-t35 and t37-t39. The (first) and (second) first-scan signals GI1 and GI2 corresponding to the first block initialization signal BI1 are activated between times t31-t33, the (first) second-scan signal GW1 in response to the first output enable signal OE1 is activated at a low level between times t33-t34. The first through third data voltages D1-D3 are respectively supplied to the first through third pixels PX1-PX3 in response to the (first) second-scan signal GW1.

The (second) second-scan signal GW2 in response to the second output enable signal OE2 is activated at a low level between times t34-t35. The first through third data voltages D1-D3 are respectively supplied to the fourth through sixth pixels PX4-PX6 in response to the (second) second-scan signal GW2. The first through third data voltages D1-D3 are supplied to the first through third pixels PX1-PX3 and then to the fourth through sixth pixels PX4-PX6 as reference numeral 411 indicates. That is, each of the (first) and (second) second-scan signals GW1 and GW2 is synchronized with a corresponding one of the first and second output enable signals OE1 and OE2.

The (third) and (fourth) first-scan signals GI3 and GI4 corresponding to the second block initialization signal BI2 are activated between times t33-t35, the (fourth) second-scan signal GW4 in response to the fourth output enable signal OE4 is activated at a low level between times t35-t36. The first through third data voltages D1-D3 are respectively supplied to the seventh through ninth pixels PX7-PX9 in response to the (third) second-scan signal GW3. The (third) second-scan signal GW3 in response to the third output enable signal OE3 is activated at a low level between times t36-t37. The first through third data voltages D1-D3 are supplied to the pixels coupled to a fourth scan line SL4 in response to the (fourth) second-scan signal GW4.

The first through third data voltages D1-D3 are supplied to the pixels coupled to the fourth scan line SL4 and then to the seventh through ninth pixels PX7-PX9 as reference numeral 413 indicates. This switching of the driving of the third and fourth scan lines SL3 and SL4 from the (forward) sequential order lessens the number of data voltage transitions that would otherwise take place when displaying the H-stripe pattern of FIG. 8.

Similarly, the (fifth) and (sixth) first-scan signals GI5 and GI6 respectively provided to the fifth and sixth scan lines SL5 and SL6 are sequentially activated between times t35-t37 and the first through third data voltages D1-D3 are supplied to the pixels coupled to the fifth and then to the sixth scan lines SL5 and SL6 as reference numeral 415 indicates.

In addition, the (seventh) and (eighth) first-scan signals GI7 and GI8 respectively provided to the seventh and eighth scan lines SL7 and SL8 are activated between times t37-t39 and the first through third data voltages D1-D3 are supplied to the pixels coupled to the eighth and then to the seventh scan lines SL8 and SL7 as reference numeral 417 indicates. This switching of the driving of the seventh and eighth scan lines SL7 and SL8 from the (forward) sequential order lessens the number of data voltage transitions that would otherwise take place when displaying the H-stripe pattern of FIG. 8.

It is noted that the (first) and (second) second-scan signals GW1 and GW2 of the first stage 210*a* overlap the (third) and (fourth) first-scan signals GI3 and GI4 of the second stage 250*a* with reference to the embodiment of FIG. 10, but the present invention is not limited thereto. In other embodiments, the (first) and (second) second-scan signals GW1 and GW2 of the first stage 210*a* may, for example, precede or follow the (third) and (fourth) first-scan signals GI3 and GI4 of the second stage 250*a*.

Figure 11:
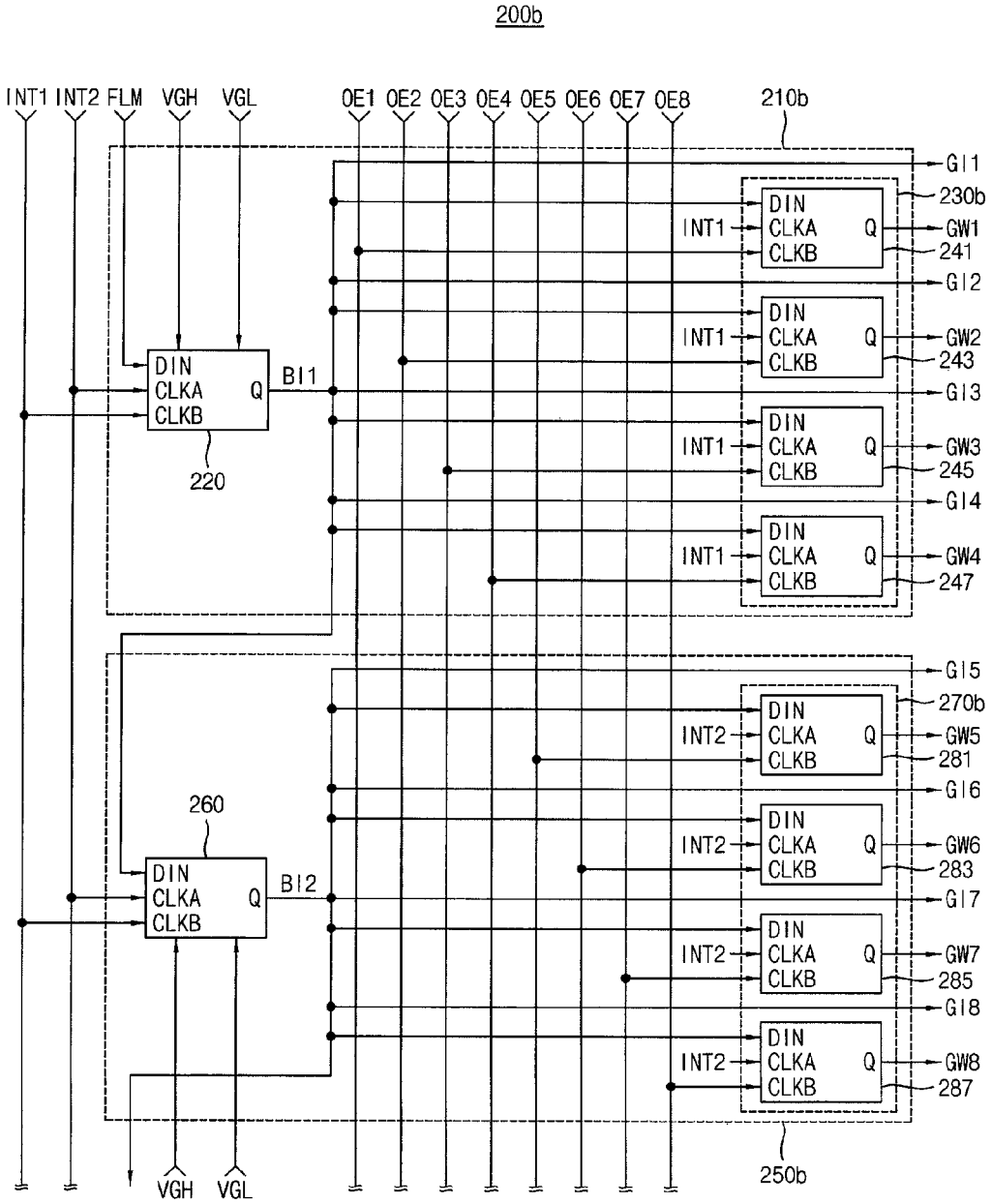
FIG. 11 illustrates an example of the scan driver of FIG. 4 according to another embodiment of the present invention.

FIG. 11 illustrates an example scan driver 200*b* of the scan driver 200 of FIG. 4 according to another embodiment of the present invention.

In FIG. 11, it is assumed that the first group of scan lines SL11-SL1*n* and the second group of scan lines SL21-SL2*n* are grouped into a plurality of scan blocks and each scan block includes four first-scan lines and four second-scan lines. Referring to FIGS. 1 and 11, the scan driver 200*b* may include a plurality of stages 210*b*, 250*b*, . . . , coupled to the pixels 111 through the first group of scan lines SL11-SL1*n* and the second group of scan lines SL21-SL2*n*, which are sequentially arranged. The stages 210*b*, 250*b*, . . . , may include common drivers 220, 260, . . . , and sub-driver units 230*b*, 270*b*, . . . , respectively. The first sub-driver unit 230*b* may include first, second, third, and fourth sub-drivers 241, 243, 245, and 247, and the second sub-driver unit 270*b* may include fifth, sixth, seventh, and eighth sub-drivers 281, 283, 285, and 287.

The first common driver 220 is part of the first stage 210*b* and may provide a first block initialization signal BI1 as (first) through (fourth) first-scan signals GI1-GI4 commonly to the (first) through (fourth) first-scan lines SL11-SL14 of a first scan block SB1 in response to the first initialization signal INT1, the second initialization signal INT2, and the starting signal FLM. The first sub-driver unit 230*b* is also part of the first stage 210*b* and may respectively provide (first) through (fourth) second-scan signals GW1-GW4 to the (first) through (fourth) second-scan lines SL21-SL24 of the first scan block SB1 in response to the first through fourth output enable signals OE1-OE4, the first block initialization signal BI1, and the first initialization signal INT1.

The first, second, third, and fourth sub-drivers 241, 243, 245, and 247 may each provide a corresponding one of the (first) through (fourth) second-scan signals GW1-GW4 to the (first) through (second) second-scan lines SL21-SL24 of the first scan block SB1 in response to a corresponding one of the first through fourth output enable signals OE1-OE4, the first block initialization signal BI1, and the first initialization signal INT1.

The second common driver 260 is part of the second stage 250*b* and may provide a second block initialization signal BI2 as (fifth) through (eighth) first-scan signals GI5-GI8 commonly to the (fifth) through (eighth) first-scan lines SL15-SL18 of a second scan block SB2 in response to the first initialization signal INT1, the second initialization signal INT2, and the first block initialization signal BI1. The second sub-driver unit 270*b* is also part of the second stage 250*b* and may respectively provide (fifth) through (eighth) second-scan signals GW5-GW8 to the (fifth) through (eighth) second-scan lines SL25-SL28 of the second scan block SB2 in response to the fifth through eighth output enable signals OE5-OE8, the second block initialization signal BI2, and the second initialization signal INT2.

The fifth, sixth, seventh, and eighth sub-drivers 281, 283, 285, and 287 may each provide a corresponding one of the (fifth) through (eighth) second-scan signals GW5-GW8 to the (fifth) through (eighth) second-scan lines SL25-SL28 of the second scan block SB2 in response to a corresponding one of the fifth through eighth output enable signals OE5-OE8, the second block initialization signal BI2, and the second initialization signal INT2.

In FIG. 11, the first and second common drivers 220 and 260 and each of the first through eighth sub-drivers 241, 243, 245, 247, 281, 283, 285, and 287 may have a substantially same configuration as the common driver 220 of FIG. 6. In addition, the first and second common drivers 220 and 260 and the first through eighth sub-drivers 241, 243, 245, 247, 281, 283, 285, and 287 may be implemented with a shift register having a same configuration.

Figure 12:
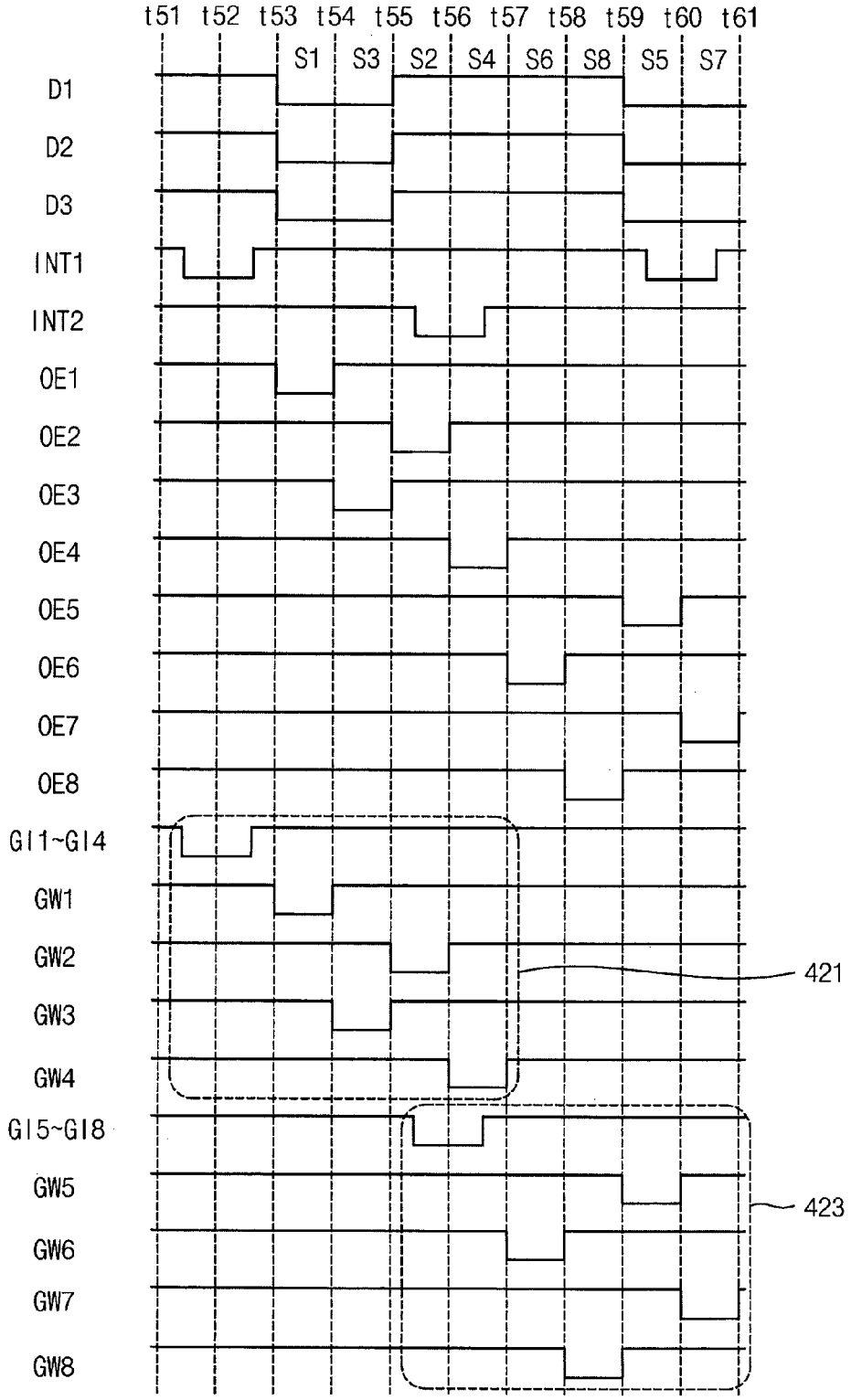
FIG. 12 illustrates an operation of the scan driver of FIG. 11 when the H-stripe pattern of FIG. 8 is displayed in the display panel of FIG. 1 according to an embodiment of the present invention.

FIG. 12 illustrates an operation of the scan driver 200*b* of FIG. 11 when the H-stripe pattern of FIG. 8 is displayed in the display panel 110 of FIG. 1 according to an embodiment of the present invention.

Referring to FIGS. 8, 9, 11, and 12, when the H-stripe pattern of FIG. 8 is displayed in the display panel 110, the data arrangement unit 133 in FIG. 3 rearranges the first through third data voltages D1-D3 such that the number of transitions of data voltages corresponding to the scan block including four scan lines is reduced or minimized, and the signal generator 134 in FIG. 3, according to the rearranged first through third data voltages D1-D3, adjusts activation timings of the first initializing signal INT1, the second initialization signal INT2, and the first through eighth output enable signals OE1-OE8, and provides the scan driver 200*b* with the adjusted first initializing signal INT1, second initialization signal INT2, and first through eighth output enable signals OE1-OE8.

The first initialization signal INT1 is activated at a low level between times t51-t53 and t59-t61, and the second initialization signal INT2 is activated at a low level between times t55-t57. The (first) through (fourth) first-scan signals GI1-GI4 corresponding to the first block initialization signal BI1 are activated between times t51-t53, the (first) through (fourth) second-scan signals GW1-GW4 in corresponding response to the first through fourth output enable signals OE1-OE4 are activated at a low level in a variation from the forward sequential order between times t53-t57 as reference numeral 421 indicates.

This variation of the driving of the first through fourth scan lines SL1-SL4 from the forward sequential order lessens the number of data voltage transitions that would otherwise take place when displaying the H-stripe pattern of FIG. 8. The first through third data voltages D1-D3 are supplied to the pixels coupled to the first through fourth scan lines SL1-SL4 in corresponding response to the (first) through (fourth) second-scan signals GW1-GW4.

Similarly, the (fifth) through (eighth) first-scan signals GI5-GI8 corresponding to the second block initialization signal BI2 are activated between times t55-t57, the (fifth) through (eighth) second-scan signals GW5-GW8 in corresponding response to the fifth through eighth output enable signals OE5-OE8 are activated at a low level in a variation from the forward sequential order between times t57-t61 as reference numeral 423 indicates. This variation of the driving of the fifth through eighth scan lines SL5-SL8 from the forward sequential order lessens the number of data voltage transitions that would otherwise take place when displaying the H-stripe pattern of FIG. 8. The first through third data voltages D1-D3 are supplied to the pixels coupled to the fifth through eighth scan lines SL5-SL8 in corresponding response to the (fifth) through (eighth) second-scan signals GW5-GW8.

It is noted that the (first) through (fourth) second-scan signals GW1-GW4 of the first stage 210*b* overlap the (fifth) through (eighth) first-scan signals GI5-GI8 of the second stage 250*b* with reference to the embodiment of FIG. 12, but the present invention is not limited thereto. In other embodiments, the (first) through (fourth) second-scan signals GW1-GW4 of the first stage 210*b* may, for example, precede or follow the (fifth) through (eighth) first-scan signals GI5-GI8 of the second stage 250*b*.

Figure 13:
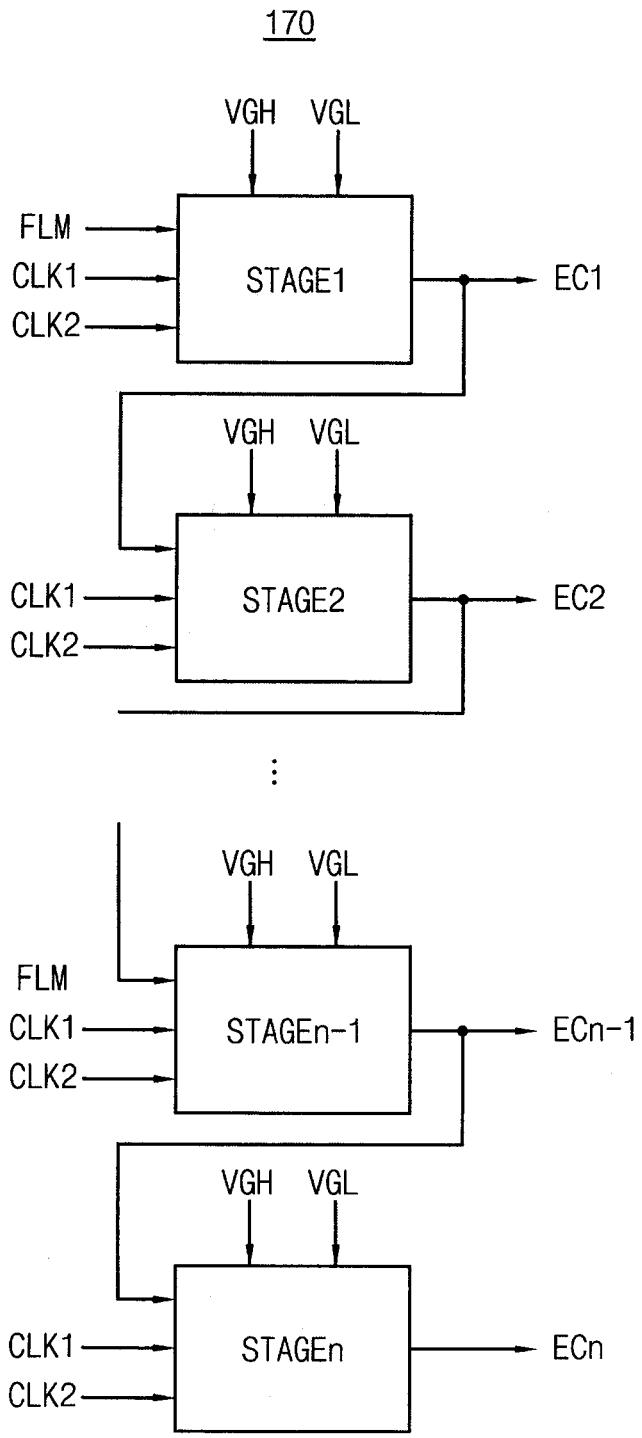
FIG. 13 is a block diagram illustrating an example emission driver shown in the OLED display device of FIG. 1 according to an embodiment of the present invention.

FIG. 13 is a block diagram illustrating an example emission driver 170 shown in the OLED display device 100 of FIG. 1 according to an embodiment of the present invention.

Referring to FIG. 13, the emission driver 170 may include a plurality of stages STAGE1-STAGEn connected to each other one after another to sequentially output the first through nth emission control signals EC1-ECn. The first through nth stages STAGE1-STAGEn are connected to the first through nth emission control lines EL1-ELn, respectively, and sequentially output the first through nth emission control signals EC1-ECn. The first through nth emission control signals EC1-ECn may overlap each other during a set or predetermined period.

Each of the first through nth stages STAGE1-STAGEn receives the first voltage VGH and the second voltage VGL having a voltage level lower than that of the first voltage VGH. In addition, each of the first through nth stages STAGE1-STAGEn receives the first clock signal CLK1 and the second clock signal CLK2. Hereinafter, the first through nth emission control signals EC1-ECn output through the first through nth emission control lines EL1-ELn are referred to as first to n-th emission control signals.

Among the first through nth stages STAGE1-STAGEn, the first stage STAGE1 is driven in response to the starting signal FLM. In further detail, the first stage STAGE1 receives the first voltage VGH and the second voltage VGL and generates the first emission control signal EC1 in response to the starting signal FLM, the first clock signal CLK1, and the second clock signal CLK2. The first emission control signal EC1 is supplied to the pixels in the first pixel row through the first emission control line EL1.

The second through nth stages STAGE2-STAGEn are connected to each other one after another (e.g., sequentially connected) and are sequentially driven. In further detail, a present stage is connected to an output terminal of a previous stage and receives the emission control signal output from the previous stage. The present stage is driven in response to the emission control signal provided from the previous stage.

For example, the second stage STAGE2 may receive the first emission control signal EC1 output from the first stage STAGE1 and is driven in response to the first emission control signal EC1. The second stage STAGE2 receives the first voltage VGH and the second voltage VGL, and generates the second emission control signal EC2 in response to the first emission control signal EC1, the first clock signal CLK1, and the second clock signal CLK2. The second emission control signal EC2 is supplied to the pixels in the second pixel row through the second emission control line EL2. The third through nth stages STAGE3-STAGEn are driven in the same way as the second stage STAGE2, and thus details thereof will not be repeated.

Figure 14:
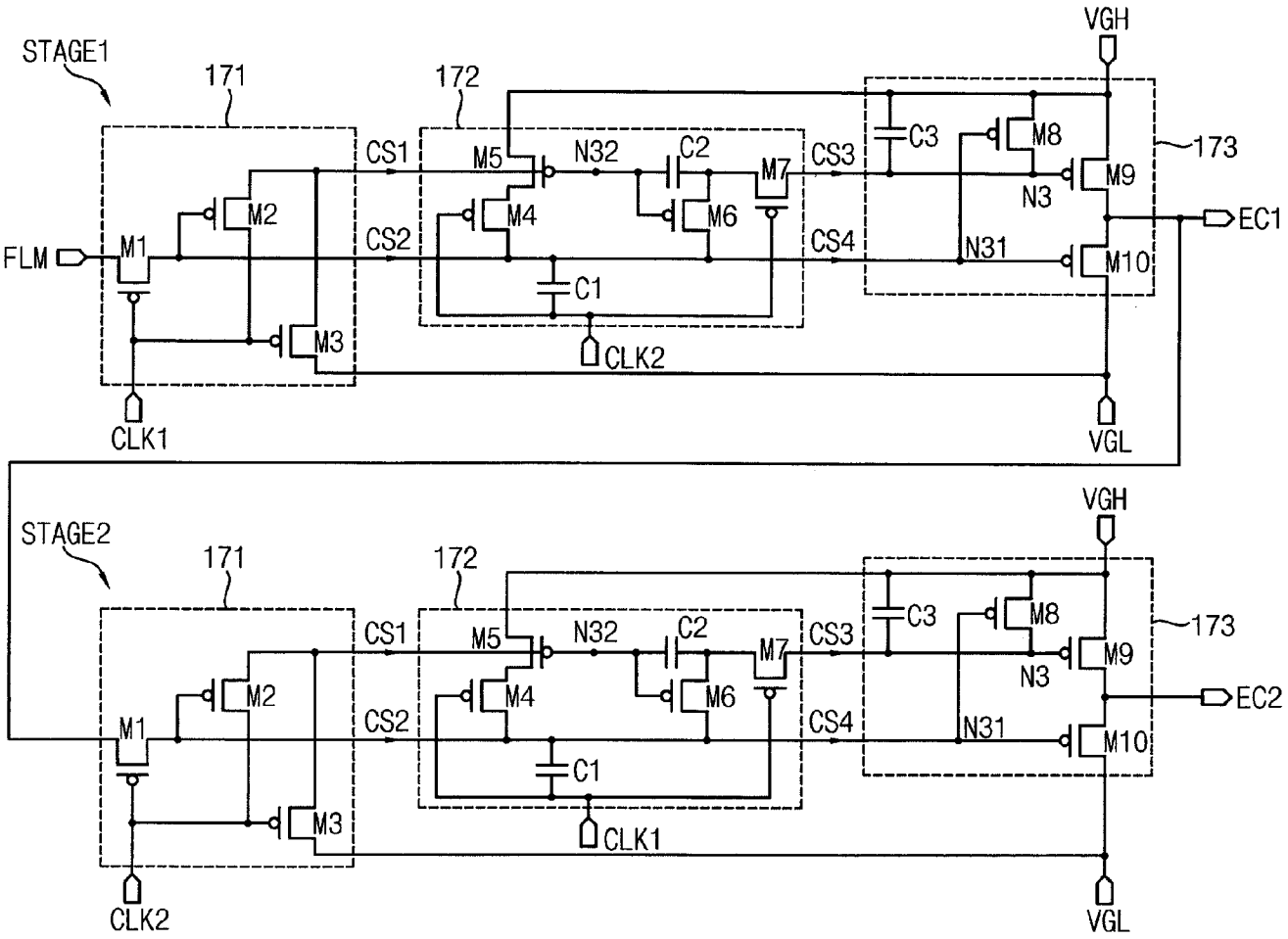
FIG. 14 is a circuit diagram illustrating stages of the emission driver in FIG. 13 according to an embodiment of the present invention.

FIG. 14 is a circuit diagram illustrating stages of the emission driver 170 in FIG. 13 according to an embodiment of the present invention.

FIG. 14 shows the circuit diagram of the first stage STAGE1 and the second stage STAGE2, but the first through nth stages STAGE1-STAGEn may have the same or substantially similar circuit configuration and function. Thus, the circuit configuration and the operation of primarily the first stage STAGE1 will be described in further detail, and the same or substantially similar circuit configuration and the operation of the other stages STAGE2-STAGEn will not be repeated or only briefly mentioned.

Referring to FIG. 14, each of the stages STAGE1-STAGEn may include a first signal processor 171, a second signal processor 172, and a third signal processor 173. The first signal processor 171 of each of the stages STAGE1-STAGEn receives a first sub-control signal and a second sub-control signal. The first signal processor 171 of each of the stages STAGE2-STAGEn receives the emission control signal output from the previous stage as the first sub-control signal. The first signal processor 171 of the first stage STAGE1 receives the starting signal FLM as the first sub-control signal. In addition, the first signal processor 171 of each of the odd-numbered stages STAGE1, STAGE3, . . . , and STAGEn−1 receives the first clock signal CLK1 as the second sub-control signal. The first signal processor 171 of each of the even-numbered stages STAGE2, STAGE4, . . . , and STAGEn receives the second clock signal CLK2 as the second sub-control signal.

Further, the first signal processor 171 receives the second voltage VGL and generates a first signal CS1 and a second signal CS2 in response to the first and second sub-control signals. The first signal CS1 and the second signal CS2 are supplied to the second signal processor 172. The first signal processor 171 of the first stage STAGE1 receives the starting signal FLM as the first sub-control signal, the first clock signal CLK1 as the second sub-control signal, and the second voltage VGL, and generates the first signal CS1 and the second signal CS2 in response to the starting signal FLM and the first clock signal CLK1. The first signal processor 171 supplies the first signal CS1 and the second signal CS2 to the second signal processor 172. The first signal processor 171 may include first, second, third transistors M1, M2, and M3. The first, second, and third transistors M1, M2, and M3 may be p-channel metal oxide semiconductor (PMOS) transistors.

The first transistor M1 has a source terminal that receives the starting signal FLM, a gate terminal that receives the first clock signal CLK1, and a drain terminal connected to a gate terminal of the second transistor M2. The second transistor. M2 has the gate terminal connected to the drain terminal of the first transistor M1, a source terminal connected to a source terminal of the third transistor M3, and a drain terminal supplied with the first clock signal CLK1. The third transistor M3 has a gate terminal that receives the first clock signal CLK1 and connected to the drain terminal of the second transistor M2, a source terminal connected to the source terminal of the second transistor M2, and a drain terminal that receives the second voltage VGL.

The first signal CS1 is output from the source terminals of the second and third transistors M2 and M3, which are connected to each other. The second signal CS2 is output from the drain terminal of the first transistor M1.

The second signal processor 172 of each of the stages STAGE1-STAGEn receives a third sub-control signal. The second signal processor 172 of each of the odd-numbered stages STAGE1, STAGE3, . . . , and STAGEn−1 receives the second clock signal CLK2 as the third sub-control signal. The second signal processor 172 of each of the even-numbered stages STAGE2, STAGE4, . . . , and STAGEn receives the first clock signal CLK1 as the third sub-control signal. The second signal processor 172 receives the third sub-control signal, the first signal CS1, the second signal CS2, and the first voltage VGH, and generates a third signal CS3 and a fourth signal CS4 in response to the third sub-control signal, the first signal CS1, and the second signal CS2. The third signal CS3 and the fourth signal CS4 are supplied to the third signal processor 173.

The second signal processor 172 of the first stage STAGE1 receives the second clock signal CLK2 as the third sub-control signal, the first signal CS1, the second signal CS2, and the first voltage VGH, and generates the third signal CS3 and the fourth signal CS4 in response to the first and second signals CS1 and CS2 from the first signal processor 171, and the second clock signal CLK2. The second signal processor 172 supplies the third signal CS3 and the fourth signal CS4 to the third signal processor 173. The second signal processor 172 may include fourth, fifth, sixth, and seventh transistors M4, M5, M6, and M7, and first and second capacitors C1 and C2. The fourth to seventh transistors M4 to M7 may be PMOS transistors.

The fourth transistor M4 has a gate terminal that receives the second clock signal CLK2, a drain terminal connected to a first node N31 and the gate terminal of the second transistor M2, and a source terminal connected to a drain terminal of the fifth transistor M5. The first capacitor C1 has a first electrode that receives the second clock signal CLK2 and a second electrode connected to the drain terminal of the fourth transistor M4 and the first node N31. The fifth transistor M5 has a gate terminal connected to the source terminal of the third transistor M3 and a second node N32, a source terminal that receives the first voltage VGH, and a drain terminal connected to the source terminal of the fourth transistor M4.

The sixth transistor M6 has a gate terminal connected to the second node N32, a source terminal connected to a drain terminal of the seventh transistor M7, and a drain terminal connected to the second electrode of the first capacitor C1 and the third node N31. The second capacitor C2 has a first electrode connected to the gate terminal of the sixth transistor M6 and a second electrode connected to the source terminal of the sixth transistor M6. The seventh transistor M7 has a gate terminal that receives the second clock signal CLK2, a source terminal connected to a third node N33, and the drain terminal connected to the source terminal of the sixth transistor M6.

The third signal CS3 is supplied to the third node N33 and the fourth signal CS4 is supplied to the first node N31. The third signal processor 173 of the first stage STAGE1 receives the first voltage VGH and the second voltage VGL, and generates the first emission control signal EC1 in response to the third signal CS3 and the fourth signal CS4 provided from the second signal processor 172. The first emission control signal EC1 is supplied to the pixels through the first emission control line EL1. The first emission control signal EC1 is also supplied (as the first sub-control signal) to the first signal processor 171 of the second stage STAGE2.

The third signal processor 173 includes eighth, ninth, and tenth transistors M8, M9, and M10, and a third capacitor C3. The eighth, ninth, and tenth transistors M8, M9, and M10 may be PMOS transistors.

The eighth transistor M8 has a gate terminal connected to the first node N31, a source terminal that receives the first voltage VGH, and a drain terminal connected to the third node N33. The third capacitor C3 has a first electrode that receives the first voltage VGH and a second electrode connected to the third node N33. The ninth transistor M9 has a gate terminal connected to the third node N33, a source terminal that receives the first voltage VGH, and a drain terminal connected to the first emission control line EL1 (for transmitting the first emission control signal EC1). The tenth transistor M10 has a gate terminal connected to the first node N31, a source terminal connected to the first emission control line EL1 (for transmitting the first control signal EC1), and a drain terminal that receives the second voltage VGL. The drain terminal of the ninth transistor M9 and the source terminal of the tenth transistor M10 are connected to the source terminal of the first transistor M1 of the first signal processor 171 of the second stage STAGE2.

Figure 15:
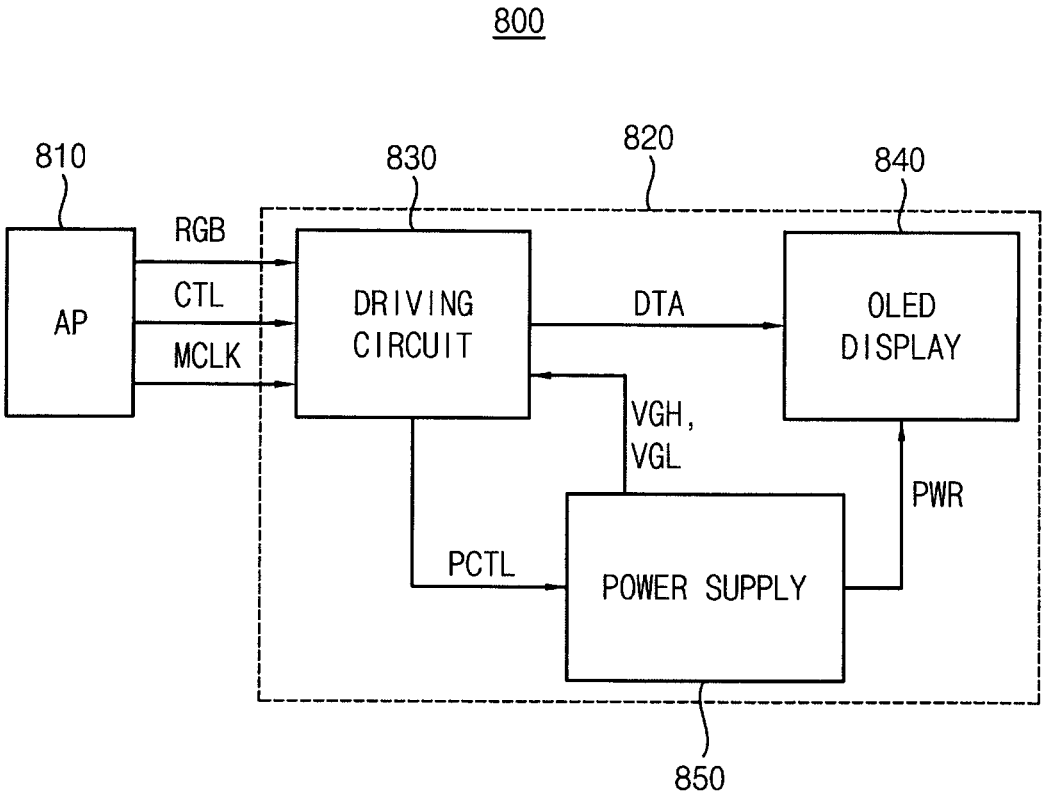
FIG. 15 is a block diagram illustrating a display system according to an embodiment of the present invention.

FIG. 15 is a block diagram illustrating a display system 800 according to an embodiment of the present invention.

Referring to FIG. 15, the display system 800 may include an application processor 810 and an OLED display device 820. The OLED display device 820 may include a driving circuit 830, a display panel 840, and a power supply 850. The power supply 850 may provide power PWR to the display panel 840 in response to a power control signal PCTL from the driving circuit 830. The power PWR may include the high power supply voltage ELVDD, the low power supply voltage ELVSS, and the initialization voltage VINT as in FIG. 1. The power supply 850 may provide the first voltage VGH and the second voltage VGL to the driving circuit 830 as illustrated in FIG. 1.

The display system 800 may be a portable device such as a laptop, a cellular phone, a smart phone, a personal computer (PC), a personal digital assistant (PDA), a portable multi-media player (PMP), a MP3 player, a navigation system, etc. The application processor 810 provides an image signal RGB, a control signal CTL, and a main clock signal MCLK to the OLED display device 820.

The driving circuit 830, the display panel 840, and the power supply 850 may be substantially same as the driving circuit 105, the display panel 110, and the power supply 180, respectively, of the OLED display device 100 of FIG. 1. Therefore, the driving circuit 830 may include a data driver and a scan driver, and the scan driver may concurrently provide first-scan signals to first-scan lines of each scan block and serially provide second-scan signals to second-scan lines of each scan block in such an order that the number of transitions of data voltages provided to pixels coupled to each scan block is reduced or minimized, where a first group of scan lines (the first-scan lines) and a second group of scan lines (the second-scan lines) are grouped into a plurality of scan blocks. Therefore, power consumption in the display system 800 may be reduced.

Figure 16:
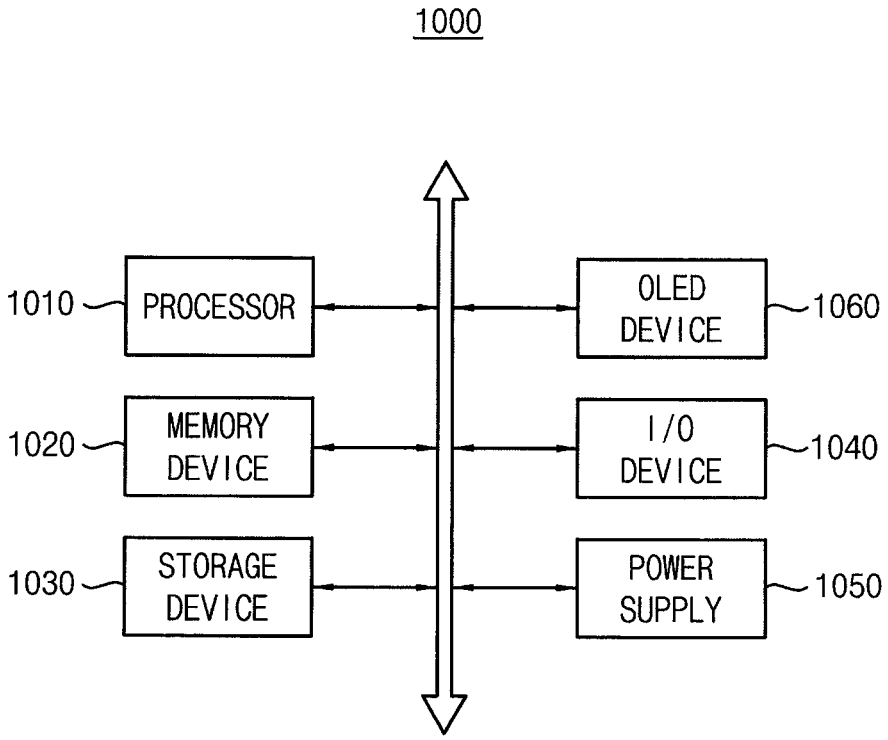
FIG. 16 is a block diagram illustrating an electronic system or device including an OLED display device according to an embodiment of the present invention.

FIG. 16 is a block diagram illustrating an electronic system or device 1000 including an OLED display device 1060 according to an embodiment of the present invention.

Referring to FIG. 16, the electronic system or device 1000 includes a processor 1010, a memory device 1020, a storage device 1030, an input/output (I/O) device 1040, a power supply 1050, and the OLED display device 1060. The power supply 850 may provide power of operation of the electronic system or device 1000. The electronic system or device 1000 may further include a plurality of ports for communicating with a video card, a sound card, a memory card, a universal serial bus (USB) device, other electronic systems, etc.

The processor 1010 may perform various computing functions or tasks. The processor 1010 may be for example, a microprocessor, a central processing unit (CPU), etc. The processor 1010 may be connected to other components via an address bus, a control bus, a data bus, etc. Further, the processor 1010 may be coupled to an extended bus such as a peripheral component interconnection (PCI) bus.

The memory device 1020 may store data for operations of the electronic system 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1030 may be, for example, a solid state drive (SSD) device, a hard disk drive (HDD) device, a CD-ROM device, etc. The I/O device 1040 may be, for example, an input device such as a keyboard, a keypad, a mouse, a touch screen, etc., and/or an output device such as a printer, a speaker, etc. The power supply 1050 may supply power for operations of the electronic system 1000. The organic light emitting display device 1060 may communicate with other components via the buses or other communication links.

The OLED display device 1060 may employ the OLED display device 100 of FIG. 1. Therefore, the OLED display device 1060 may include a driving circuit and a display panel, and the driving circuit may include a data driver and a scan driver. The scan driver may concurrently provide first-scan signals to first-scan lines of each scan block and serially provide second-scan signals to second-scan lines of each scan block in such an order that the number of transitions of data voltages provided to pixels coupled to each scan block is reduced or minimized, where a first group of scan lines (the first-scan lines) and a second group of scan lines (the second-scan lines) are grouped into a plurality of scan blocks. Therefore, power consumption in the electronic device 1000 may be reduced.

Embodiments of the present invention may be applied to any electronic device 1000 having the organic light emitting display device 1060. For example, embodiments of the present invention may be applied to the electronic system 1000, such as a television, a computer monitor, a laptop, a digital camera, a cellular phone, a smart phone, a personal digital assistant (PDA), a portable multimedia player (PMP), an MP3 player, a navigation system, a video phone, etc.

The present invention may be applied to any display device or any electronic device including a display device displaying a stereoscopic image. For example, the present invention may be applied to a television, a computer monitor, a laptop, a digital camera, a cellular phone, a smart phone, a personal digital assistant (PDA), a portable multimedia player (PMP), a MP3 player, a navigation system, a video phone, etc.

The foregoing is illustrative of example embodiments and is not to be construed as limiting thereof. Although a few embodiments of the present invention have been described, those skilled in the art will readily appreciate that many modifications are possible without materially departing from the novel teachings and features of the present invention. Accordingly, all such modifications are intended to be included within the scope of the present invention as defined in the claims. Therefore, it is to be understood that the foregoing is illustrative of various example embodiments and is not to be construed as limited to the specific embodiments disclosed, and that modifications to the disclosed embodiments, as well as other embodiments that would. be apparent to one of ordinary skill, are intended to be included within the spirit and scope of the appended claims, and equivalents thereof.

What is claimed is:

1. A scan driver of an organic light emitting diode (OLED) display device, the scan driver comprising:

a plurality of sequentially-connected stages each connected to a plurality of pixels through a plurality of first-scan lines and a plurality of second-scan lines, each stage of the plurality of sequentially-connected stages comprising:

a common driver configured to concurrently provide a common first-scan signal to the first-scan lines of the stage in response to at least a first initialization signal and a second initialization signal; and a sub-driver unit configured to serially provide second-scan signals to the second-scan lines of the stage in response to a plurality of output enable signals, the first-scan signal, and one of the first initialization signal and the second initialization signal, an order of the serial providing of the second-scan signals to the second-scan lines being dynamically configurable based on the output enable signals.

2. The scan driver of claim 1, wherein the sub-driver unit is further configured to serially provide the second-scan signals to the second-scan lines of the stage after the concurrent providing of the common first-scan signal to the first-scan lines of the stage.

3. The scan driver of claim 1, wherein the sub-driver unit comprises a plurality of sub-drivers corresponding to the plurality of second-scan lines of the stage.

4. The scan driver of claim 3, wherein each sub-driver of the plurality of sub-drivers is configured to provide a corresponding one of the second-scan signals to a corresponding one of the second-scan lines of the stage in response to the common first-scan signal, one of the output enable signals, and the one of the first initialization signal and the second initialization signal of the stage.

5. The scan driver of claim 4, wherein the corresponding one of the second-scan signals is synchronized with the one of the output enable signals supplied to the sub-driver.

6. An organic light emitting diode (OLED) display device comprising:

a display panel comprising a plurality of pixels;

a driving circuit connected to the pixels through a plurality of scan blocks and a plurality of data lines, each of the scan blocks comprising a plurality of first-scan lines and a plurality of second-scan lines, the driving circuit being configured to provide first-scan signals to the first-scan lines of each of the scan blocks, to serially provide second-scan signals to the second-scan lines of each of the scan blocks, to provide data voltages to the data lines, and to adjust the serial providing of the second-scan signals to the second-scan lines of each of the scan blocks to lessen a number of transitions of the data voltages of the data lines compared to a sequential providing of the second-scan signals to the second-scan lines in each of the scan blocks; and a power supply to supply a low power supply voltage, a high power supply voltage, and an initialization voltage to the display panel.

7. The OLED display device of claim 6, wherein the driving circuit comprises:

a scan driver configured to provide the first-scan signals and the second-scan signals to the pixels for each of the scan blocks;

a data driver configured to provide the data voltages corresponding to data signals to the data lines connected to the pixels;

an emission driver configured to provide emission control signals to a plurality of emission control lines connected to the pixels; and a timing controller configured to control the scan driver, the data driver, the emission driver, and the power supply, wherein the timing controller is configured to process input image data to generate the data signals.

8. The OLED display device of claim 7, wherein the timing controller comprises:

a block memory to store the input image data for the pixels connected to one or more of the scan blocks;

a data analyzer to analyze the data voltage transitions of the input image data stored in the block memory to generate a scan sequence signal and a scan sequence control signal to lessen the number of data voltage transitions of the data lines compared to the sequential providing of the second-scan signals to the second-scan lines of the one or more of the scan blocks;

a data arrangement unit to arrange the input image data according to the scan sequence signal to generate the data signals; and a signal generator to generate at least a first driving control signal to control the data driver and a second driving control signal to control the scan driver according to an input control signal and the scan sequence control signal.

9. The OLED display device of claim 8, wherein the scan driver comprises a plurality of sequentially-connected stages corresponding to the plurality of scan blocks, each stage of the plurality of sequentially-connected stages corresponding to a scan block of the plurality of scan blocks and comprising:

a common driver configured to concurrently provide a common one of the first-scan signals to the first-scan lines of the scan block in response to at least a first initialization signal and a second initialization signal; and a sub-driver unit configured to serially provide ones of the second-scan signals to the second-scan lines of the scan block in response to a plurality of output enable signals, the one of the first-scan signals, and one of the first initialization signal and the second initialization signal, an order of the serial providing of the ones of the second-scan signals to the second-scan lines being dynamically configurable based on the output enable signals.

10. The OLED display device of claim 9, wherein the common driver comprises:

a first p-channel metal-oxide semiconductor (PMOS) transistor comprising a source coupled to a data terminal, a gate coupled to a first node coupled to a first clock terminal, and a drain coupled to a second node;

a second PMOS transistor comprising a gate coupled to a second clock terminal and a drain coupled to the second node;

a third PMOS transistor comprising a drain coupled to a source of the second PMOS transistor, a source coupled to a third node to receive a first voltage, and a gate coupled to a fourth node;

a first capacitor coupled between the third node and the fourth node;

a fourth PMOS transistor comprising a gate coupled to the second node, a drain coupled to the first node, and a source coupled to the fourth node;

a fifth PMOS transistor comprising a source coupled to the fourth node, a gate coupled to the first node, and a drain to receive a second voltage;

a sixth PMOS transistor comprising a source coupled to the third node, a gate coupled to the fourth node, and a drain coupled to a fifth node corresponding to an output terminal;

a second capacitor coupled between the second node and the fifth node; and a seventh PMOS transistor comprising a source coupled to the fifth node, a gate coupled to the second node, and a drain coupled to the second clock terminal.

11. The OLED display device of claim 10, wherein the first clock terminal is configured to receive the second initialization signal, the second clock terminal is configured to receive the first initialization signal, the output terminal is configured to provide the one of the first scan signals, the data terminal of a first stage of the plurality of sequentially-connected stages is configured to receive a starting signal, and the data terminal of each next stage of the plurality of sequentially-connected stages is configured to receive the one of the first-scan signals of a corresponding previous stage of the plurality of sequentially-connected stages.

12. The OLED display device of claim 11, wherein the output terminal is configured to output a low level when the second node is a low level and the first initialization signal is a low level.

13. The OLED display device of claim 9, wherein the sub-driver unit comprises a plurality of sub-drivers corresponding to the plurality of second-scan lines in the scan block, the common driver is configured to supply the one of the first-scan signals commonly to each of the sub-drivers, and each of the sub-drivers is configured to provide a corresponding second-scan signal of the ones of the second-scan signals to a corresponding one of the second-scan lines of the scan block in response to the one of the first-scan signals, one of the output enable signals, and the one of the first initialization signal and the second initialization signal.

14. The OLED display device of claim 13, wherein each of the sub-drivers has a same configuration as the common driver.

15. The OLED display device of claim 9, wherein the ones of the second-scan signals of the stage overlap the one of the first-scan signals of a corresponding next stage of the plurality of sequentially-connected stages.

16. The OLED display device of claim 8, wherein the signal generator is further configured to generate a third driving control signal to control the emission driver and a power control signal to control the power supply based on the input control signal.

17. The OLED display device of claim 6, wherein each of the pixels comprises:

a switching transistor comprising a first terminal coupled to one of the data lines, a gate terminal coupled to one of the second-scan lines, and a second terminal coupled to a first node;

a storage capacitor connected between the high, power supply voltage and a second node;

a driving transistor comprising a first terminal coupled to the first node, a gate terminal coupled to the second node, and a second terminal coupled to a third node;

a compensation transistor comprising a first terminal coupled to the second node, a gate terminal coupled to the one of the second-scan lines, and a second terminal coupled to the third node;

an initialization transistor comprising a first terminal coupled to the second node, a gate terminal coupled to one of the first-scan lines, and a second terminal coupled to the initialization voltage;

a discharge transistor comprising a first terminal coupled to the initialization voltage, a gate terminal coupled to the one of the second-scan lines, and a second terminal coupled to a fourth node;

a first emission transistor comprising a first terminal coupled to the high power supply voltage, a gate terminal configured to receive an emission control signal, and a second terminal coupled to the first node;

a second emission transistor comprising a first terminal coupled to the third node, a gate terminal configured to receive the emission control signal, and a second terminal coupled to the fourth node; and an OLED connected between the fourth node and the low power supply voltage.

18. The OLED display device of claim 17, wherein the compensation transistor is configured to diode-connect the driving transistor in response to one of the second-scan signals being supplied to the one of the second-scan lines.

19. The OLED display device of claim 17, wherein the initialization transistor is configured to transfer the initialization voltage to the gate terminal of the driving transistor in response to a corresponding one of the first-scan signals being supplied to the one of the first-scan lines to initialize a data voltage transferred to the driving transistor during a previous frame, and the discharge transistor is configured to discharge a parasitic capacitance between the second emission transistor and the OLED in response to one of the second-scan signals being supplied to the one of the second-scan lines.

20. A display system comprising:

an application processor configured to generate image data and an input control signal; and an organic light emitting diode (OLED) display device configured to display the image data in response to the input control signal, wherein the OLED display device comprises:

a display panel comprising a plurality of pixels;

a driving circuit connected to the pixels through a plurality of scan blocks and a plurality of data lines, each of the scan blocks comprising a plurality of first-scan lines and a plurality of second-scan lines, the driving circuit being configured to provide first-scan signals to the first-scan lines of each of the scan blocks, to serially provide second-scan signals to the second-scan lines of each of the scan blocks, to provide data voltages to the data lines, and to adjust the serial providing of the second-scan signals to the second-scan lines of each of the scan blocks to lessen a number of transitions of the data voltages of the data lines compared to a sequential providing of the second-scan signals to the second-scan lines in each of the scan blocks; and a power supply to supply a low power supply voltage, a high power supply voltage, and an initialization voltage to the display panel.

* * * * *